US009964112B2

(12) United States Patent
Yamato et al.

(10) Patent No.: US 9,964,112 B2
(45) Date of Patent: May 8, 2018

(54) MOLECULAR PUMP

(71) Applicant: Osaka Vacuum, Ltd., Osaka (JP)

(72) Inventors: Yukio Yamato, Osaka (JP); Tetsuro Obayashi, Osaka (JP)

(73) Assignee: Osaka Vacuum, Ltd., Osaka (JP)

( * ) Notice: Subject to any disclaimer, the term of this patent is extended or adjusted under 35 U.S.C. 154(b) by 533 days.

(21) Appl. No.: 14/423,541

(22) PCT Filed: Aug. 27, 2013

(86) PCT No.: PCT/JP2013/072823
§ 371 (c)(1),
(2) Date: Feb. 24, 2015

(87) PCT Pub. No.: WO2014/034645
PCT Pub. Date: Mar. 6, 2014

(65) Prior Publication Data

US 2015/0184665 A1 Jul. 2, 2015

(30) Foreign Application Priority Data

Aug. 28, 2012 (JP) ..... 2012-187454

(51) Int. Cl.
*F04D 19/04* (2006.01)
*F04D 27/00* (2006.01)
(Continued)

(52) U.S. Cl.
CPC ..... *F04D 19/042* (2013.01); *F04D 25/068* (2013.01); *F04D 27/00* (2013.01);
(Continued)

(58) Field of Classification Search
CPC ..... F04D 19/042; F04D 25/068; F04D 27/00; F04D 29/58; F04D 29/5813; F04D 29/584
See application file for complete search history.

(56) References Cited

U.S. PATENT DOCUMENTS 5,144,811 A 9/1992 Brodie et al.
8,651,838 B2 * 2/2014 Birkenstock ..... F04D 17/168 417/423.4
(Continued)

FOREIGN PATENT DOCUMENTS

CN 102782331 A 11/2012
CN 103228923 A 7/2013
(Continued)

OTHER PUBLICATIONS

An Office Action; "Grounds for Rejection," issued by the Chinese Patent Office on Apr. 5, 2016, which corresponds to Chinese Patent Application No. 201380056267.6 and is related to U.S. Appl. No. 14/423,541; with English language translation.
(Continued)

*Primary Examiner* — Christopher Verdier
*Assistant Examiner* — Kayla McCaffrey
(74) *Attorney, Agent, or Firm* — Studebaker & Brackett PC

(57) ABSTRACT

A molecular pump includes a pump body provided with a turbo molecular pump portion, a control unit provided with a control portion and a power supply portion, and a cooling unit for cooling the pump body and the control unit. A first temperature detecting portion is provided in a first position, which is a position inside the control unit and has a low temperature. A second temperature detecting portion also serving as a humidity detecting portion is provided in a second position, which is a position inside the control unit and has a high temperature. The control portion controls the operation of the cooling unit in accordance with a relative humidity in the first position, calculated based on temperature information detected by the first temperature detecting portion and based on temperature information and humidity information detected by the second temperature detecting portion also serving as a humidity detecting portion.

9 Claims, 15 Drawing Sheets

(51) Int. Cl.
*F04D 29/58* (2006.01)
*F04D 25/06* (2006.01)

(52) U.S. Cl.
CPC ..... *F04D 29/58* (2013.01); *F04D 29/584* (2013.01); *F04D 29/5813* (2013.01)

(56) References Cited

U.S. PATENT DOCUMENTS

| | | | |
|---|---|---|---|
| 2010/0303644 | A1 | 12/2010 | Moriyama et al. |
| 2012/0321442 | A1 | 12/2012 | Nagano et al. |
| 2013/0189089 | A1 | 7/2013 | Schroder et al. |

FOREIGN PATENT DOCUMENTS

| | | | | |
|---|---|---|---|---|
| JP | H11-173293 | A | | 6/1999 |
| JP | 2009-174333 | A | | 8/2009 |
| JP | 2010-210443 | A | | 9/2010 |
| JP | 2011-027031 | A | | 2/2011 |
| WO | WO2006016302 | A1 | * | 10/2006 |

OTHER PUBLICATIONS

International Search Report; PCT/JP2013/072823; dated Nov. 26, 2013.

The extended European search report issued by the European Patent Office dated Mar. 17, 2016, which corresponds to European Patent Application No. 13833701.9-1607 and is related to U.S. Appl. No. 14/423,541.

* cited by examiner

MOLECULAR PUMP

TECHNICAL FIELD

The present invention relates to a molecular pump, which is a type of vacuum pump for creating an ultra-high vacuum, and more particularly to a molecular pump including a cooling unit as a cooling system.

BACKGROUND ART

Molecular pumps are attached as vacuum pumps for creating an ultra-high vacuum to various processing apparatuses represented by, for example, semiconductor manufacturing apparatuses, various analytical apparatuses, electron microscopes, and the like. A molecular pump generally includes a pump body provided with a turbo molecular pump portion including rotor blades and stator blades, and a control unit that accommodates a control portion for controlling the operation of the turbo molecular pump portion and a power supply portion for supplying electric power for driving the turbo molecular pump portion.

In the molecular pump, the power supply portion included in the control unit includes a booster circuit, a converter circuit, an inverter circuit, and the like, which are sources of heat generation, and it is thus necessary to appropriately cool these components. Similarly in the pump body, heat is generated at motors for causing rotation of a rotor having rotor blades, a bearing that supports a rotation shaft for causing rotation of the rotor, and the like, and it is thus necessary to appropriately cool these components.

Hence, a molecular pump is known to which a liquid cooling-type cooling unit through which a cooling liquid can be circulated is attached. Japanese Patent Laying-Open No. 11-173293 (PTD 1), for example, discloses a molecular pump wherein a cooling unit is sandwiched between a pump body and a control unit, and Japanese Patent Laying-Open No. 2011-27031 (PTD 2) discloses a molecular pump wherein a pump body and a control unit are arranged side-by-side on a cooling unit.

Generally, the control unit is often of a semi-hermetic-type communicating with the outside and having a drip-proof structure and a dust-proof structure whereby entry of liquid drips and dust particles is appropriately prevented. In this case, the dew-point temperature inside the control unit is equal to the dew-point temperature of an ambient environment. Therefore, the portion where the above-described cooling unit is arranged in contact therewith or close thereto has a locally low temperature, and if this temperature decreases below the dew-point temperature, condensation will form on this portion.

If such condensation forms, attachment of a condensation liquid to the above-described various circuits may cause a failure or a malfunction. It is thus necessary to inhibit the formation of condensation inside the control unit as much as possible.

To inhibit the formation of condensation, Japanese Patent Laying-Open No. 2009-174333 (PTD 3), for example, discloses a molecular pump wherein a pipe through which a cooling liquid can be circulated inside a control unit is installed, and a condensation sensor is mounted inside the control unit, so that the circulation of the cooling liquid is stopped when condensation is detected by the condensation sensor.

CITATION LIST

Patent Document

PTD 1: Japanese Patent Laying-Open No. 11-173293
PTD 2: Japanese Patent Laying-Open No. 2011-27031
PTD 3: Japanese Patent Laying-Open No. 2009-174333

SUMMARY OF INVENTION

Technical Problem

However, when the structure disclosed in PTD 3 above is adopted, some little condensation is already formed when the condensation sensor has detected condensation. Thus, even though the formation of further condensation can be inhibited, the formation of condensation itself cannot be prevented.

That is, although it will also depend on the position of a condensation sensor inside the control unit, if the condensation sensor is arranged in a portion where condensation is most likely to form (for example, a portion near a pipe through which a cooling liquid can be circulated), condensation will be already formed in that portion when the condensation is detected. Considering that a condensation liquid does not easily evaporate, the various circuits such as the power supply portion and the like may be adversely affected if the condensation liquid is splashed for some reason. If the condensation sensor is mounted near the power supply portion that is a source of heat generation, condensation will be already formed in the power supply portion as well when the condensation is detected, which will inevitably cause an adverse effect on the power supply portion.

Therefore, from the viewpoint of reliably preventing the formation of condensation itself, it is contemplated to use and arrange a humidity detecting portion such as a humidity sensor or the like, instead of the condensation sensor, in a portion where condensation is most likely to form inside the control unit, and predict the formation of condensation based on humidity information detected by the humidity detecting portion, and control circulation of the cooling liquid based on the prediction.

However, even with this structure, if a condensation liquid is attached to the humidity detecting portion because of a change in the ambient environment during stoppage or the like of the molecular pump, for example, a considerable length of time will be required until the attached condensation liquid evaporates. Consequently, during the period until the evaporation, humidity cannot be detected at all by the humidity detecting portion. This is because no practical humidity detecting portion is available that can detect humidity continuously, stably, and accurately in a very high humidity environment in which condensation would form. Since general humidity detecting portions electrically detect changes in humidity, they become incapable of measuring humidity if a condensation liquid attaches to the sensing electrode or the like.

Therefore, in practice, it is necessary to arrange a humidity detecting portion at a considerable distance from the portion where condensation is most likely to form. As a result, a humidity of the portion where condensation is most likely to form, which should originally be measured, cannot be measured, and in some cases, this may lead to undesired stoppage of cooling operation. Consequently, efficient operation of the molecular pump cannot be performed.

Accordingly, the present invention was made to solve the aforementioned problem, and an object of the invention is to provide a molecular pump that can continuously, stably, and accurately calculate a relative humidity in a portion where condensation is most likely to form inside a control unit, thereby allowing the formation of condensation to be reliably prevented, and making efficient operation feasible.

Solution to Problem

A molecular pump based on a first aspect of the present invention includes a pump body provided with a turbo molecular pump portion including a rotor blade and a stator blade; a control unit provided with a control portion and a power supply portion; and a cooling unit for cooling the pump body and the control unit. In the molecular pump, each of the pump body and the control unit is arranged in contact with or close to the cooling unit, such that the cooling unit and the pump body are brought into thermal contact, and the cooling unit and the control unit are brought into thermal contact. The control unit has a cover in which the control portion and the power supply portion are accommodated. A first temperature detecting portion is provided in a first position, which is a position inside the cover and has a low temperature during operation of the cooling unit. A humidity detecting portion and a second temperature detecting portion are provided in a second position, which is a position inside the cover and has a temperature higher than the temperature of the first position during the operation of the cooling unit. The control portion controls the operation of the cooling unit in accordance with a relative humidity in the first position, calculated based on temperature information detected by the first temperature detecting portion and the second temperature detecting portion, and based on humidity information detected by the humidity detecting portion.

In the molecular pump based on the present invention, the control portion preferably causes the cooling unit to execute the cooling operation where the relative humidity is equal to or lower than a predetermined threshold value, and causes the cooling unit to stop the cooling operation where the relative humidity is higher than the threshold value.

In the molecular pump based on the present invention, the first position is preferably a position on an inner surface of the cover corresponding to a portion arranged in contact with or close to the cooling unit, and the second position is preferably a position other than a position on the inner surface of the cover corresponding to the portion arranged in contact with or close to the cooling unit.

In the molecular pump based on the present invention, the second position is preferably a position on a circuit board disposed inside the control unit.

In the molecular pump based on the present invention, the cooling unit is preferably disposed to be sandwiched between the pump body and the control unit.

In the molecular pump based on the present invention, the pump body and the control unit are arranged side-by-side on the cooling unit.

In the molecular pump based on the present invention, the control portion controls operation of the turbo molecular pump portion based on the relative humidity.

The molecular pump based on the present invention preferably further includes a ventilation mechanism for ventilation of a gas inside the control unit, wherein the control portion may control operation of the ventilation mechanism based on the relative humidity.

The molecular pump based on the present invention preferably further includes a heating mechanism for heating the gas inside the control unit, wherein the control portion may control operation of the heating mechanism based on the relative humidity.

A molecular pump based on a second aspect of the present invention includes a pump body provided with a turbo molecular pump portion including a rotor blade and a stator blade; a control unit provided with a control portion and a power supply portion; and a cooling unit for cooling the control unit. In the molecular pump, the control unit is arranged in contact with or close to the cooling unit, such that the cooling unit and the control unit are brought into thermal contact. The control unit has a cover in which the control portion and the power supply portion are accommodated. A first temperature detecting portion is provided in a first position, which is a position inside the cover and has a low temperature during operation of the cooling unit. A humidity detecting portion and a second temperature detecting portion are provided in a second position, which is a position inside the cover and has a temperature higher than the temperature of the first position during the operation of the cooling unit. The control portion controls the operation of the cooling unit in accordance with a relative humidity in the first position, calculated based on temperature information detected by the first temperature detecting portion and the second temperature detecting portion, and based on humidity information detected by the humidity detecting portion.

Advantageous Effects of Invention

According to the present invention, there is provided a molecular pump that can continuously, stably, and accurately calculate a relative humidity in the portion where condensation is most likely to form inside a control unit, thereby allowing the formation of condensation to be reliably prevented, and making efficient operation feasible.

DESCRIPTION OF EMBODIMENTS

Figure 1:
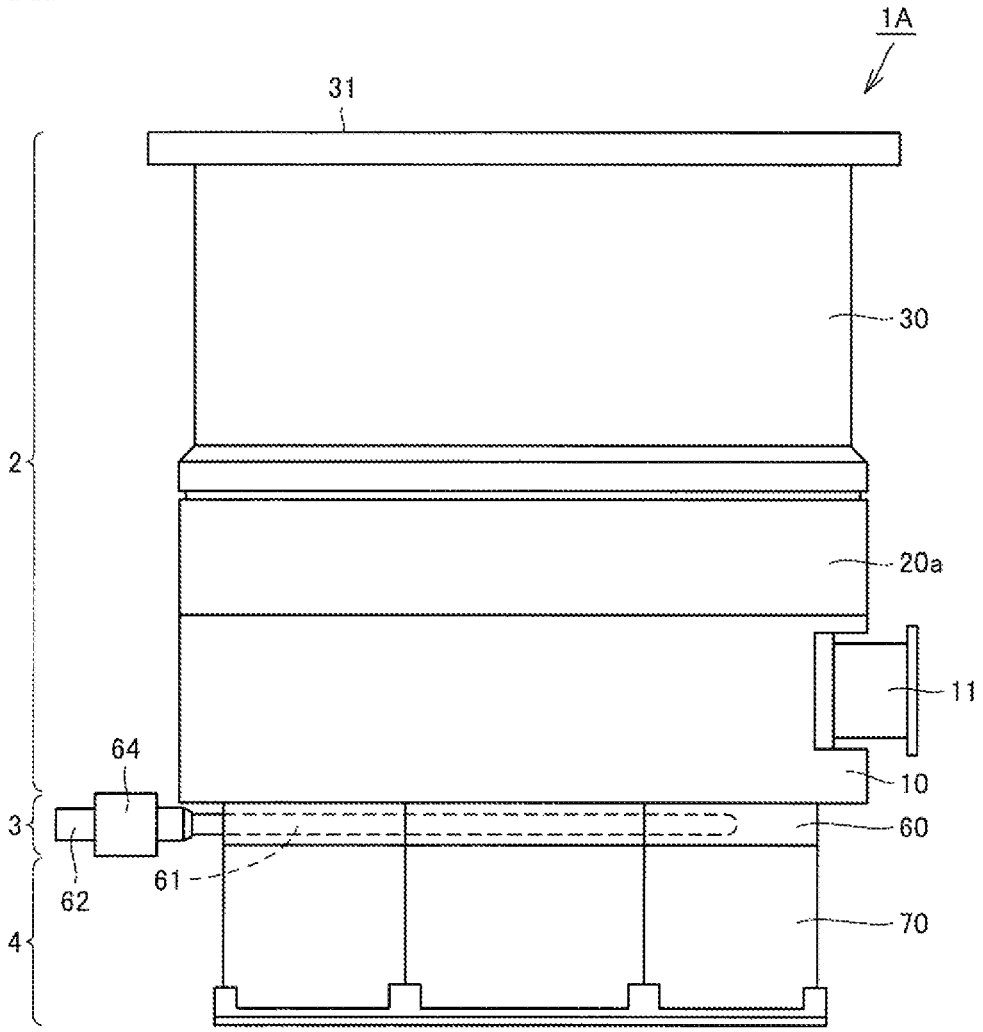
FIG. 1 is a front view of a molecular pump according to a first embodiment of the present invention.

Hereinafter, embodiments of the present invention will be described in detail referring to the drawings. In the below-described embodiments, description will be provided by illustrating cases where the present invention is applied to so-called composite molecular pumps wherein a turbo molecular pump portion and a spiral groove vacuum pump portion are arranged together. In the below-described embodiments, the same reference numerals indicate the same or common portions in the drawings, and description thereof will not be repeated.

First Embodiment

Figure 2:
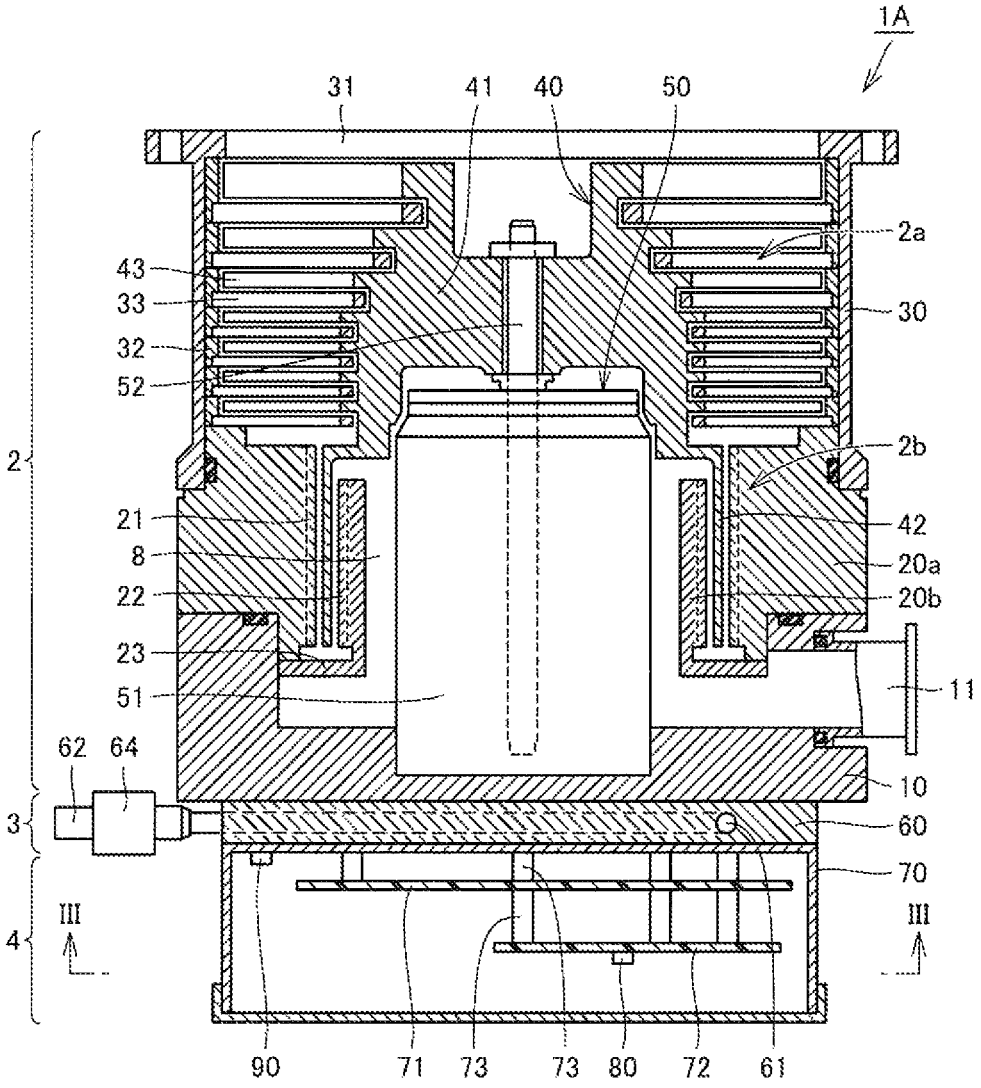
FIG. 2 is a schematic vertical cross-sectional view of the molecular pump according to the first embodiment of the present invention.
Figure 3:
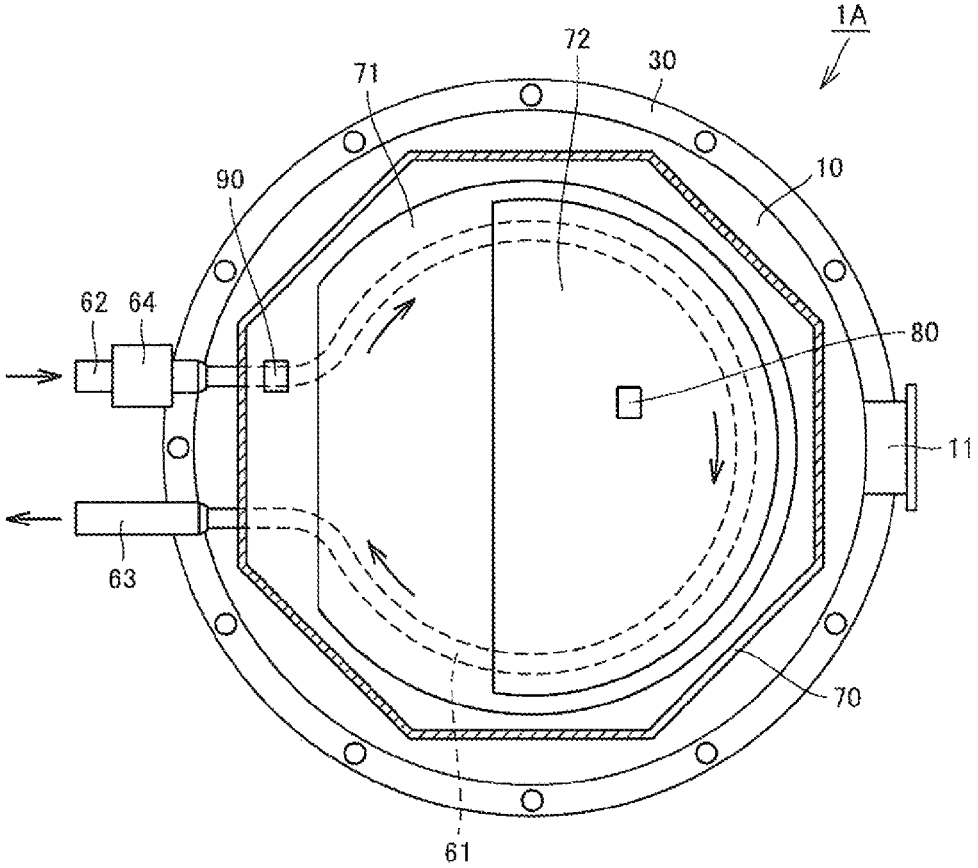
FIG. 3 is a schematic horizontal cross-sectional view of the molecular pump according to the first embodiment of the present invention.
Figure 4:
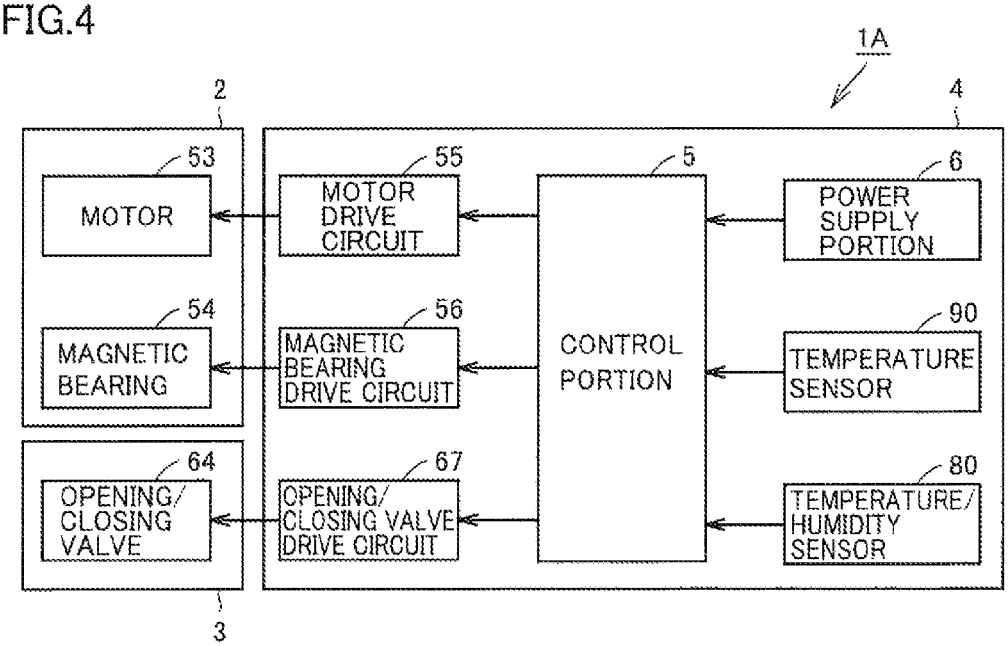
FIG. 4 is a diagram illustrating the configuration of a functional block of the molecular pump according to the first embodiment of the present invention.

FIG. 1 is a front view of a molecular pump according to a first embodiment of the present invention. FIG. 2 is a schematic vertical cross-sectional view of the molecular pump shown in FIG. 1, and FIG. 3 is a schematic horizontal cross-sectional view of the molecular pump along line III-III shown in FIG. 2. FIG. 4 is a diagram illustrating a functional block of the molecular pump shown in FIG. 1. Referring to FIGS. 1 to 4, the configuration of a molecular pump 1A according to this embodiment will be described first.

As shown in FIGS. 1 and 2, molecular pump 1A according to this embodiment includes a pump body 2, a single cooling unit 3, and a control unit 4. Pump body 2, cooling unit 3, and control unit 4 are vertically stacked on one another. More specifically, cooling unit 3 is disposed on control unit 4, and pump body 2 is disposed on cooling unit 3. Cooling unit 3 is thus sandwiched between pump body 2 and control unit 4.

Pump body 2 is for creating an ultra-high vacuum. Pump body 2 has a turbo molecular pump portion 2*a* in an upper section thereof, and has a spiral groove vacuum pump portion 2*b* in a lower section thereof. An intake port 31 and an exhaust pipe 11 are also provided in the upper section and the lower section of pump body 2, respectively, so as to communicate with turbo molecular pump portion 2*a* and spiral groove vacuum pump portion 2*b*. A specific configuration of pump body 2 will be described below.

Various circuits forming a control portion 5, a power supply portion 6 (see FIG. 4), and the like described below are accommodated in control unit 4. Control unit 4 is covered with a semi-hermetic cover 70. Mainly, a first substrate 71 and a second substrate 72, serving as circuit boards, are disposed inside cover 70. Electronic components or the like are mounted on first substrate 71 and second substrate 72 to form the above-described various circuits. A specific configuration of control unit 4 will be described below.

Cooling unit 3 is for cooling pump body 2 and control unit 4, and mainly includes a cooling block 60 in which a cooling liquid passage 61 through which a cooling liquid such as cooling water can be circulated is formed inside, and a below-described piping system connected to cooling liquid passage 61. A specific configuration of cooling unit 3 will be described below.

As is clear from the above-described configuration, in molecular pump 1A according to this embodiment, cooling unit 3 and pump body 2 are arranged in contact with each other to be brought into thermal contact, and cooling unit 3 and control unit 4 are arranged in contact with each other to be brought into thermal contact. By adopting this configuration, both pump body 2 and control unit 4 can be cooled with single cooling unit 3, thereby allowing the overall configuration of molecular pump 1A to be simplified.

To enhance cooling efficiency, a high thermal conductivity sheet or a grease, for example, may be interposed between pump body 2 and cooling unit 3, and between control unit 4 and cooling unit 3, as required. In this case, cooling unit 3 and pump body 2 are arranged close to each other to be brought into thermal contact, and cooling unit 3 and control unit 4 are arranged close to each other to be brought into thermal contact.

As shown in FIGS. 1 to 3, pump body 2 mainly includes a base 10, an outer stator 20*a*, an inner stator 20*b*, a casing 30, a rotor 40, and a rotor drive mechanism 50. Rotor drive mechanism 50 includes a motor 53 and a magnetic bearing 54 shown in FIG. 4.

Of these components, base 10, outer stator 20*a*, and casing 30 form an outer shell of pump body 2, and the remaining inner stator 20*b*, rotor 40, and rotor drive mechanism 50 are accommodated in pump body 2. Inside pump body 2, an exhaust path 8 is also provided that communicates the above-described intake port 31 and exhaust pipe 11.

Base 10 has a substantially disc-like shape, and is arranged such that a lower surface thereof is brought into thermal contact with an upper surface of cooling block 60. Outer stator 20*a* and rotor drive mechanism 50 are placed on base 10, and more specifically, outer stator 20*a* is placed on a peripheral edge portion of base 10, and rotor drive mechanism 50 is placed on a central portion of base 10. The above-described exhaust pipe 11 is connected to a prescribed position on base 10.

Rotor drive mechanism 50 has a rotation shaft 52 and a housing 51 in which the above-described motor 53, magnetic bearing 54, and the like are accommodated. Rotor drive mechanism 50 is for causing rotor 40 to rotate at high speed. Rotation shaft 52 has its lower-end portion positioned inside housing 51, and its upper-end portion exposed outside housing 51. Rotor 40 is fixed to the exposed portion of rotation shaft 52.

Motor 53 rotationally drives rotation shaft 52 to which rotor 40 is fixed, and magnetic bearing 54 rotatably supports rotation shaft 52. When motor 53 and magnetic bearing 54 are driven, rotation shaft 52 rotates to cause rotor 40 to rotate at high speed.

Rotor 40 has an upper rotor portion 41 with a substantially columnar shape that is fixed to rotation shaft 52 and a lower rotor portion 42 with a substantially cylindrical shape. On an outer peripheral portion of upper rotor portion 41, a plurality of rotor blades 43 are spaced along an axial direction, and each of the plurality of rotor blades 43 is positioned to protrude radially outward. On the other hand, lower rotor portion 42 is arranged to extend downward from a lower end of upper rotor portion 41 to surround the above-described housing 51.

Outer stator 20*a* has a substantially cylindrical shape and surrounds the above-described housing 51, and is also arranged such that a portion thereof faces an outer peripheral surface of the above-described lower rotor portion 42.

Inner stator 20*b* has a substantially cylindrical shape and surrounds the above-described housing 51, and is also arranged inside outer stator 20*a* to face an inner peripheral surface of lower rotor portion 42. Inner stator 20*b* also has a closing portion 23 that extends radially outward from a lower end thereof, and the lower end of lower rotor portion 42 is positioned to face closing portion 23.

An internal screw-shaped primary spiral groove portion 21 is provided on an inner peripheral surface of outer stator 20*a* of the portion facing the outer peripheral surface of lower rotor portion 42. On the other hand, an external screw-shaped secondary spiral groove portion 22 is provided on an outer peripheral surface of inner stator 20*b* of the portion facing the inner peripheral surface of lower rotor portion 42.

In this way, the above-described spiral groove vacuum pump portion 2*b* is formed by lower rotor portion 42, outer stator 20*a*, and inner stator 20*b*, so that spiral groove vacuum pump portion 2*b* exhibits an exhaust function with lower rotor portion 42 rotating between outer stator 20*a* and inner stator 20*b* at high speed, during the operation of molecular pump 1A.

Casing 30 has a substantially cylindrical shape, and is placed on outer stator 20*a* to surround upper rotor portion 41. The above-described intake port 31 is positioned on the top of casing 30.

A plurality of spacer/support members 32 are provided on an inner peripheral surface of casing 30, and a plurality of stator blades 33 are supported by the plurality of spacer/support members 32. The plurality of stator blades 33 are spaced along the axial direction, each being positioned to protrude radially inward.

Each of the plurality of rotor blades 43 and each of the plurality of stator blades 33 described above have turbine blades inclined in directions differing from each other. Moreover, each of the plurality of rotor blades 43 and each of the plurality of stator blades 33 described above are disposed such that they are positioned alternately along the axial direction.

In this way, the above-described turbo molecular pump portion 2*a* is formed by the plurality of rotor blades 43 and the plurality of stator blades 33, so that turbo molecular pump portion 2*a* exhibits an exhaust function with the plurality of rotor blades 43 rotating at high speed, during the operation of molecular pump 1A.

A sealing member such as an O ring or the like is interposed between base 10 and outer stator 20*a*, between outer stator 20*a* and casing 30, and between base 10 and exhaust pipe 11, for example. This ensures airtightness of exhaust path 8 that reaches exhaust pipe 11 from intake port 31, thereby allowing prevention of air leakage between components forming exhaust path 8.

As shown in FIGS. 1 to 4, in addition to the above-described cooling block 60, cooling unit 3 also includes an inlet port 62, an outlet port 63, and an opening/closing valve 64 serving as a piping system.

Inlet port 62 is a port for supplying the cooling liquid to cooling liquid passage 61. Inlet port 62 has its one end connected to a liquid feed equipment not shown herein, and its other end connected to one end of cooling liquid passage 61 provided in cooling block 60.

Outlet port 63 is a port for discharging the cooling liquid from cooling liquid passage 61. Outlet port 63 has its one end connected to a liquid discharge equipment not shown herein, and its other end connected to the other end of cooling liquid passage 61 provided in cooling block 60.

Opening/closing valve 64, which is for switching between supply of the cooling liquid to cooling liquid passage 61 and stoppage thereof, is attached to inlet port 62.

In this way, while opening/closing valve 64 is open, the cooling liquid is supplied to cooling liquid passage 61, so that the cooling operation by cooling unit 3 is executed, and while opening/closing valve 64 is closed, the supply of the cooling liquid to cooling liquid passage 61 is stopped, so that the cooling operation by cooling unit 3 is stopped.

Cooling liquid passage 61 is preferably distributed over a wider region of cooling block 60, so as to allow the wider region to be cooled. From this viewpoint, cooling liquid passage 61 in this embodiment is provided in a substantially annular form in a plan view.

As shown in FIGS. 1 to 3, in addition to the above-described cover 70, first substrate 71, and second substrate 72, control unit 4 also includes spacer/support members 73, a temperature sensor 90 as a first temperature detecting portion, and a temperature/humidity sensor 80 as a humidity detecting portion and a second temperature detecting portion.

As shown, cover 70 has a box-like shape whose external shape is an octagonal prism, for example, and is arranged such that an upper surface thereof is brought into thermal contact with a lower surface of cooling block 60 of cooling unit 3. A top plate portion of cover 70 in contact with cooling unit 3 is provided with spacer/support members 73 made of a high thermal conductivity member to stand upright toward the inside of cover 70. First substrate 71 and second substrate 72 are supported by spacer/support members 73. Here, from the viewpoint of saving space, first substrate 71 and second substrate 72 are arranged to face each other at a prescribed distance along the vertical direction.

First substrate 71 is provided with a power supply portion 6 including a booster circuit, a converter circuit, an inverter circuit, and the like, which are sources of heat generation. Power supply portion 6 is supplied with electric power from an external power supply such as a commercial power supply or the like, and thereby converts this electric power into electric power in a condition suitable mainly for rotationally driving rotor 40 at high speed.

Second substrate 72 is provided with control portion 5 that controls the overall operation of molecular pump 1A, as well as various drive circuits represented by below-described motor drive circuit 55, magnetic bearing drive circuit 56, and opening/closing valve drive circuit 67, for example.

Temperature sensor 90 is attached to a prescribed position (corresponding to a first position) on an inner surface of the top plate portion of cover 70. Temperature/humidity sensor 80 is made of a composite sensor having both a temperature sensor and a humidity sensor, and is mounted on a prescribed position (corresponding to a second position) on second substrate 72 described above. Here, a thermistor, for example, can be suitably used as the temperature sensor, and a resistance-type or capacitance-type humidity sensor, for example, can be suitably used as the humidity sensor.

Here, the above-described first position in which temperature sensor 90 is provided corresponds to a position having a low temperature during the operation of cooling unit 3, and the above-described second position in which temperature/ humidity sensor 80 is provided corresponds to a position having a temperature higher than that of the first position during the operation of cooling unit 3. As shown in FIG. 3, temperature sensor 90 is more suitably provided in a position on an inner surface of cover 70 corresponding to a portion of cooling liquid passage 61 near the connection to inlet port 62 of cooling unit 3. This position is most efficiently cooled by cooling unit 3, and corresponds to the portion where condensation is most likely to form inside control unit 4.

As shown in FIG. 4, molecular pump 1A has motor drive circuit 55, magnetic bearing drive circuit 56, and opening/closing valve drive circuit 67, in addition to the above-described control portion 5, power supply portion 6, motor 53, magnetic bearing 54, opening/closing valve 64, temperature sensor 90, and temperature/humidity sensor 80.

Motor drive circuit 55 drives motor 53 based on a control signal input from control portion 5. Magnetic bearing drive circuit 56 drives magnetic bearing 54 based on a control signal input from control portion 5. Opening/closing valve drive circuit 67 drives opening/closing valve 64 based on a control signal input from control portion 5.

Control unit 5 includes an operation processing portion, a memory portion, and a determination portion not shown herein. At the operation processing portion, control portion 5 performs below-described operations based on temperature information and humidity information detected by temperature sensor 90 and temperature/humidity sensor 80, and at the determination portion, control portion 5 compares the calculated result with threshold values stored in the memory portion, and inputs a control signal to each of the above-described drive circuits based on the compared result.

With molecular pump 1A described above, the relative humidity in the portion to which temperature sensor 90 is attached, which corresponds to the portion where condensation is most likely to form inside control unit 4, can be calculated continuously, stably, and accurately. A reason for this will be described hereinafter.

Figure 5:
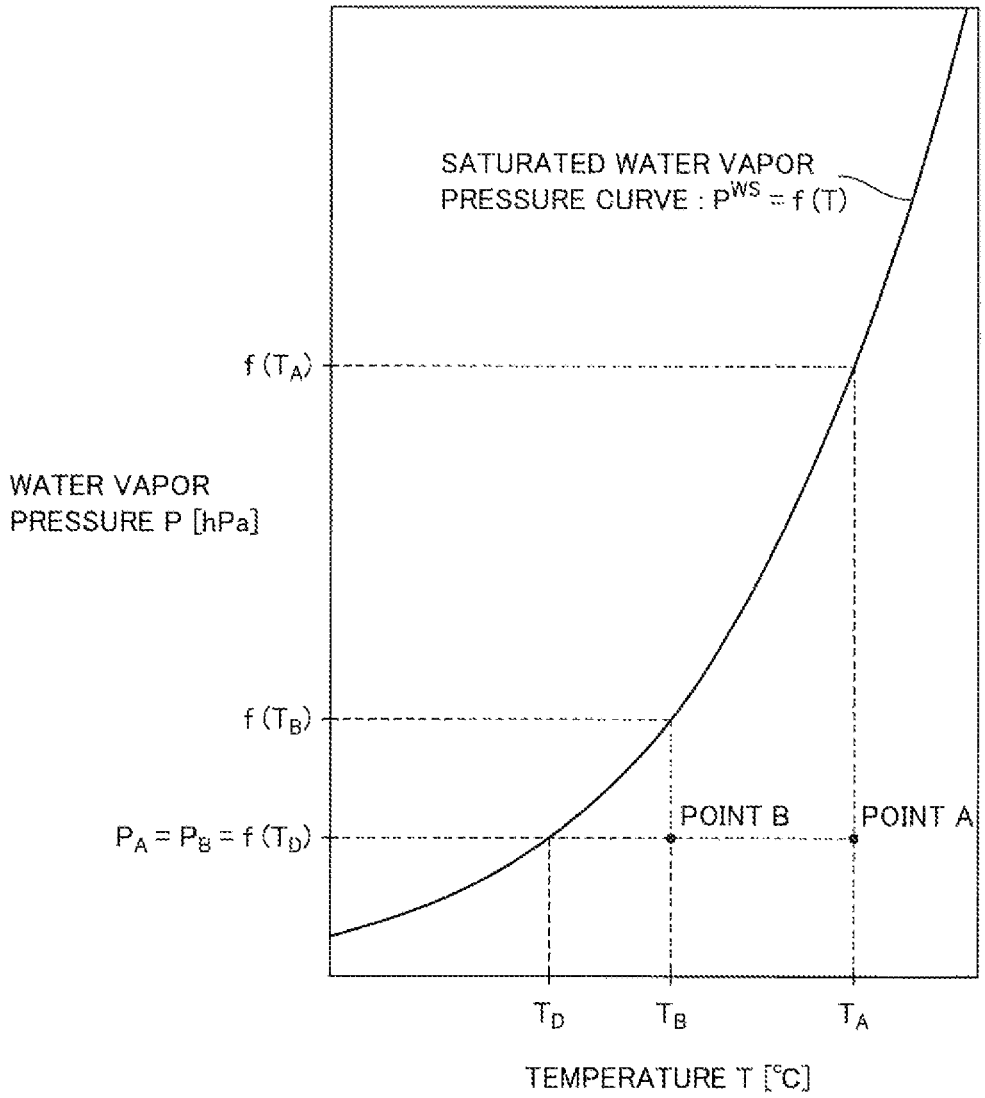
FIG. 5 is a graph showing a saturated water vapor pressure curve.

FIG. 5 is a graph showing a saturated water vapor pressure curve. As is known already, when the horizontal axis represents temperature T [° C.], and the vertical axis represents water vapor pressure P [hPa], saturation water vapor pressure curve $P^{WS}$ [hPa] is expressed by the curve as shown in FIG. 5. Here, while many formulae have been proposed as function f (T), which is an approximate expression of the saturated water vapor pressure curve, the Magnus-Tetens formula (the following formula (1)), for example, that is widely used in the weather field can be used.

[Formula 1]

$$P^{WS} = f(T) = 6.107 \times 10^{\frac{7.5 \times T}{T+237.3}} \quad (1)$$

When a temperature of the first position in which temperature sensor 90 is provided is denoted as $T_B$ [° C.], a relative humidity thereof is denoted as $H_B$ [%], and a water vapor pressure thereof is denoted as $P_B$ [hPa] the following formula (2) is established between them using function f (T) above:

[Formula 2]

$$H_B = \frac{P_B}{f(T_B)} \times 100 \quad (2)$$

When a temperature of the second position in which temperature/humidity sensor 80 is provided is denoted as $T_A$ [° C.], a relative humidity thereof is denoted as $H_A$ [%], and a water vapor pressure thereof is denoted as $P_A$ [hPa] the following formula (3) is established between them using function f (T) above:

[Formula 3]

$$H_A = \frac{P_A}{f(T_A)} \times 100 \quad (3)$$

Here, as described above, because control unit 4 is covered with semi-hermetic cover 70, the space inside control unit 4 can be considered as a closed space. Therefore, water vapor pressure $P_A$ [hPa] at the first position and water vapor pressure $P_B$ [hPa] at the second position will both be equal to a saturated water vapor pressure $f(T_D)$ [hPa] at a dew-point temperature $T_D$ [° C.] inside control unit 4, and hence, the following formula (4) is established:

[Formula 4]

$$P_A = P_B \quad (4)$$

Hence, based on formulae (2) to (4) above, the following formula (5) can be derived:

[Formula 5]

$$H_B = \frac{f(T_A)}{f(T_B)} \times H_A \quad (5)$$

As described above, relative humidity $H_B$ [%] in the first position can be calculated by performing operations at the operation processing portion of control portion 5, based on temperature $T_B$ [° C.] detected by temperature sensor 90 provided in the first position, as well as temperature $T_A$ [° C.] and relative humidity $H_A$ [%] detected by temperature/humidity sensor 80 provided in the second position.

Figure 6:
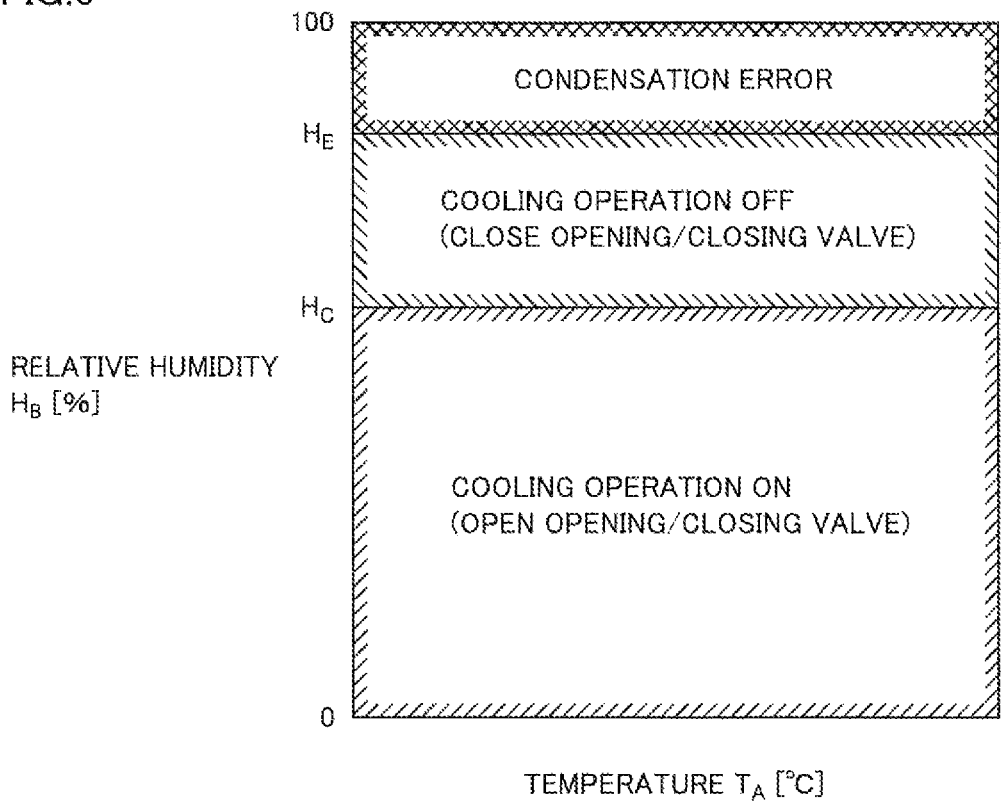
FIG. 6 is a diagram illustrating an operation table showing a first configuration example of control operation by a control portion of the molecular pump according to the first embodiment of the present invention.
Figure 7:
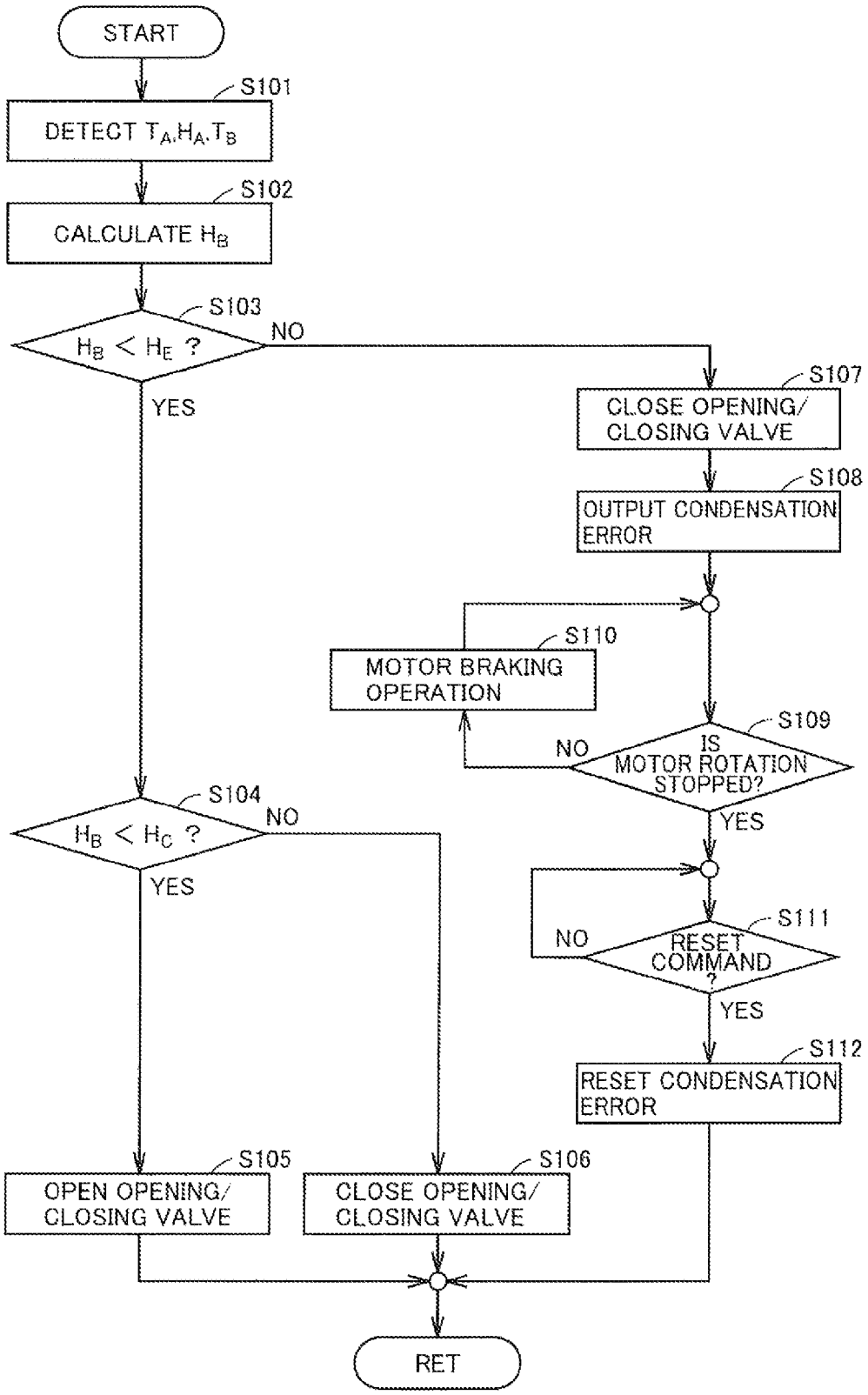
FIG. 7 is a flowchart showing the first configuration example of the control operation by the control portion of the molecular pump according to the first embodiment of the present invention.
Figure 8:
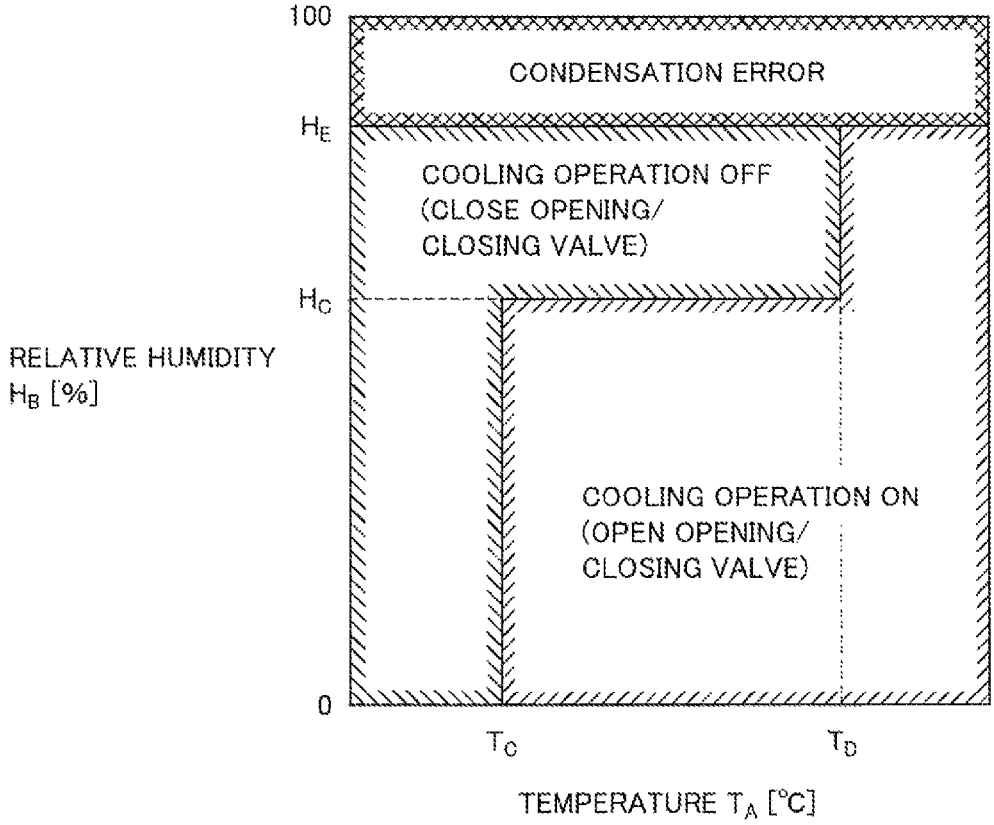
FIG. 8 is a diagram illustrating an operation table showing a second configuration example of the control operation by the control portion of the molecular pump according to the first embodiment of the present invention.
Figure 9:
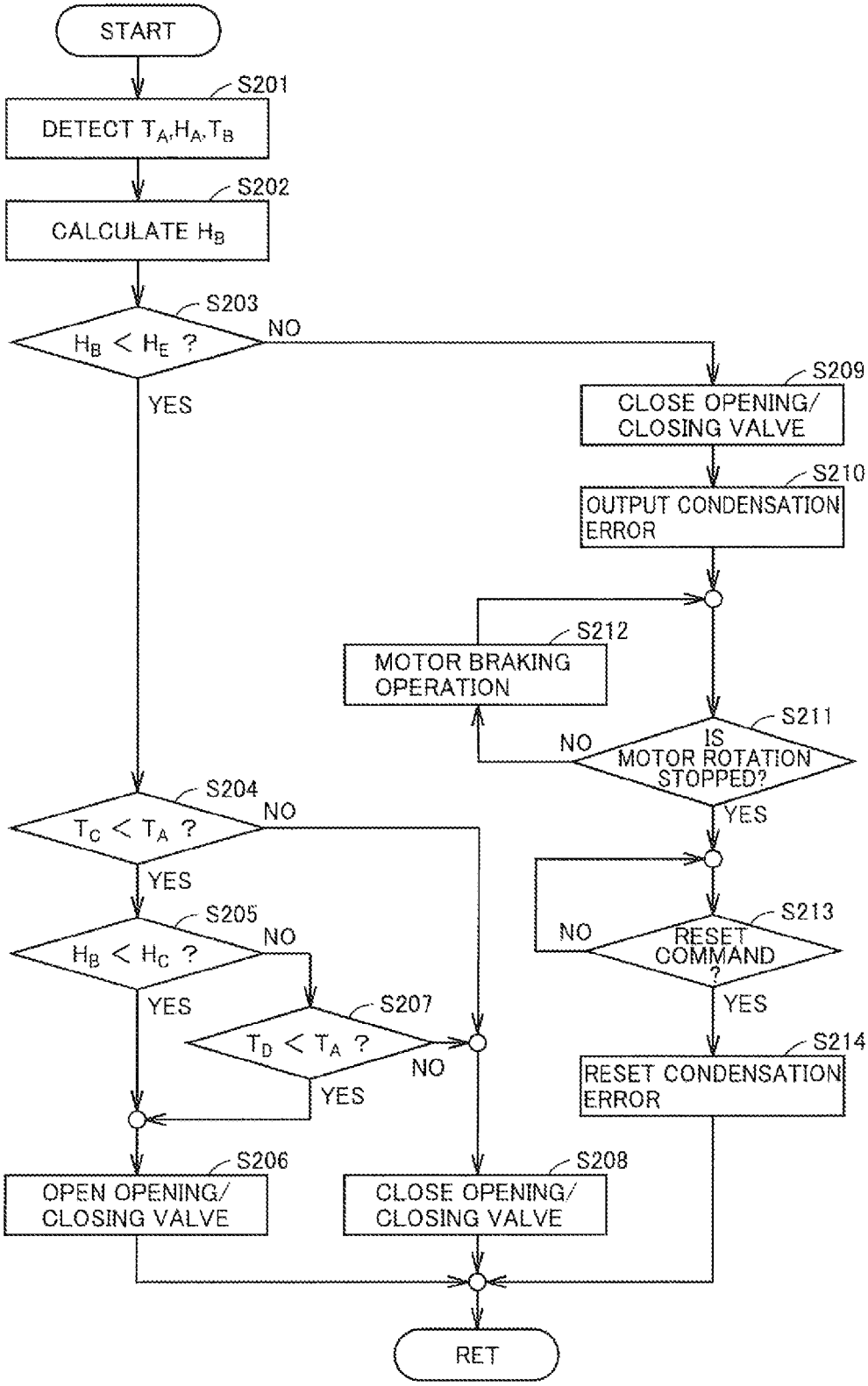
FIG. 9 is a flowchart showing the second configuration example of the control operation by the control portion of the molecular pump according to the first embodiment of the present invention.

Next, a specific configuration example of control operation by control portion 5 in accordance with relative humidity $H_B$ [%] in the first position calculated based on the above will be described. FIG. 6 is a diagram illustrating an operation table and FIG. 7 is a flowchart, each showing a first configuration example of the control operation by the control portion of the molecular pump according to this embodiment. FIG. 8 is a diagram illustrating an operation table and FIG. 9 is a flowchart, each showing a second configuration example of the control operation by the control portion of the molecular pump according to this embodiment.

As shown in FIG. 6, in the first configuration example, control portion 5 controls the operation of cooling unit 3 and the operation of pump body 2 (the rotational operation of rotor 40 for driving turbo molecular pump portion 2*a* and spiral groove vacuum pump portion 2*b*, namely, the rotational operation of motor 53), by comparing calculated relative humidity $H_B$ [%] with a predetermined first threshold value $H_C$ [%] and a predetermined second threshold value $H_E$ [%].

Specifically, when calculated relative humidity $H_B$ [%] is lower than first threshold value $H_C$ [%] control portion 5 opens opening/closing valve 64, thereby causing cooling unit 3 to execute the cooling operation. That is, it can be determined that condensation is not formed in a state where the relative humidity in the first position is comparatively low, and thus, the cooling operation is executed.

When calculated relative humidity $H_B$ [%] is equal to or higher than first threshold value $H_C$ [%], and lower than second threshold value $H_E$ [%], control portion 5 closes opening/closing valve 64, thereby causing the cooling operation by cooling unit 3 to stop. That is, it can be determined that condensation is likely to form in a state where the relative humidity in the first position is comparatively high, and thus, the cooling operation is stopped.

When calculated relative humidity $H_B$ [%] is equal to or higher than second threshold value $H_E$ [%], control portion 5 informs a user of a condensation error by performing predetermined condensation error processing. That is, it can be determined that condensation is highly likely to form or is likely to have been formed in a state where the relative humidity in the first position is significantly high, and thus, this state is informed to the user.

The foregoing control operation can be implemented through the control flow shown in FIG. 7, for example. The control flow is performed by control portion 5 retrieving and executing a program stored in the above-described memory portion or the like.

As shown in FIG. 7, in step S101, control portion 5 detects temperature $T_B$ [° C.], temperature $T_A$ [° C.], and relative humidity $H_A$ [%]. Specifically, control portion 5 obtains from temperature sensor 90 and temperature/humidity sensor 80 the temperature information and the humidity information detected by temperature sensor 90 and temperature/humidity sensor 80.

Next, in step S102, control portion 5 calculates relative humidity $H_B$ [%]. Specifically, control portion 5 calculates relative humidity $H_B$ [%] by performing operation processing at the operation processing portion based on formulae (1) and (5) shown above, based on temperature $T_B$ [° C.], temperature $T_A$ [° C.], and relative humidity $H_A$ [%] obtained in step S101.

Next, in step S103, control portion 5 determines whether relative humidity $H_B$ [%]. [%] is lower than second threshold value $H_E$ [%] or not. Specifically, control portion 5 makes the above determination by comparing relative humidity $H_B$ [%] calculated in step S102 with predetermined second threshold value $H_E$ [%] at the determination portion.

Where control portion 5 determines that relative humidity $H_B$ [%] is lower than second threshold value $H_E$ [%] (YES in step S103), it moves to step S104, and where control portion 5 determines that relative humidity $H_B$ [%] is equal to or higher than second threshold value $H_E$ [%] (NO in step S103), it moves to step S107.

In step S104, control portion 5 determines whether relative humidity $H_B$ [%] is lower than first threshold value $H_C$[%] or not. Specifically, control portion 5 makes the above determination by comparing relative humidity $H_B$ [%] calculated in step S102 with predetermined first threshold value $H_C$ [%] at the determination portion.

Where control portion 5 determines that relative humidity $H_B$ [%] is lower than first threshold value $H_C$ [%] (YES in step S104), it moves to step S105, and where control portion 5 determines that relative humidity $H_B$ [%] is equal to or higher than first threshold value $H_C$ [%] (NO in step S104), it moves to step S106.

In step S105, control portion 5 opens opening/closing valve 64. Consequently, the cooling operation by cooling unit 3 is executed. After completion of step S105, control portion 5 returns to the operation of step S101 again.

In step S106, control portion 5 closes opening/closing valve 64. Consequently, the cooling operation by cooling unit 3 is stopped. After completion of step S106, control portion 5 returns to the operation of step S101 again.

On the other hand, in step S107, control portion 5 closes opening/closing valve 64. Consequently, the cooling operation by cooling unit 3 is stopped.

Next, control portion 5 outputs a condensation error in step S108, and informs the user that condensation is highly likely to form or is likely to have been formed, and subsequently in step S109, determines whether the rotation of motor 53 is stopped or not.

Where control portion 5 determines that the rotation of motor 53 is stopped (YES in step S109), it moves to step S111, and where control portion 5 determines that the rotation of motor 53 is not stopped (No in step S109), it moves to step S110 where it switches the operation of motor 53 to a braking operation.

In step S111, control portion 5 determines whether a reset command has been input by the user or not. Where control portion 5 determines that a reset command has not been input by the user (NO in step S111), it is put on standby, and where control portion 5 determines that a reset command has been input by the user (YES in step S111), it moves to step S112 where it resets the condensation error. After completion of step S112, control portion 5 returns to the operation of step S101 again.

As shown in FIG. 8, in the second configuration example, control portion 5 controls the operation of cooling unit 3 and the operation of pump body 2 (the rotational operation of rotor 40 for driving turbo molecular pump portion 2*a* and spiral groove vacuum pump portion 2*b*, namely, the rotational operation of motor 53), by comparing calculated relative humidity $H_B$ [%] with predetermined first threshold value $H_C$ [%] and predetermined second threshold value $H_E$ [%] and also by comparing detected temperature $T_A$ [° C.] with a predetermined third threshold value $T_C$ [° C.] and a predetermined fourth threshold value $T_D$ [° C.]

Specifically, when detected temperature $T_A$ [° C.] is lower than the third threshold value $T_C$ [° C.] and calculated relative humidity $H_B$ [%] is lower than second threshold value $H_E$ [%], control portion 5 causes cooling unit 3 to stop the cooling operation, by closing opening/closing valve 64. That is, it can be determined that in a state where the temperature in the second position is comparatively low, the necessity for cooling is low in the first place regardless of the likelihood of condensation, and thus, the cooling operation is stopped.

When calculated relative humidity $H_B$ [%] is lower than first threshold value $H_C$ [%], and detected temperature $T_A$ [° C.] is equal to or higher than third threshold value $T_C$ [° C.] and lower than fourth threshold value $T_D$ [° C.], control portion 5 causes cooling unit 3 to execute the cooling operation, by opening opening/closing valve 64. That is, it can be determined that condensation is not formed in a state where the temperature in the second position is comparatively high and the relative humidity in the first position is comparatively low, and thus, the cooling operation is executed.

When calculated relative humidity $H_B$ [%] is equal to or higher than first threshold value $H_C$ [%] and lower than second threshold value $H_E$ [%], and when detected temperature $T_A$ [° C.] is equal to or higher than third threshold value $T_C$ [° C.] and lower than fourth threshold value $T_D$ [° C.], control portion 5 causes cooling unit 3 to stop the cooling operation, by closing opening/closing valve 64. That is, it can be determined that condensation is likely to form in a state where the temperature in the second position is comparatively high and the relative humidity in the first position is comparatively high, and thus, the cooling operation is stopped.

When detected temperature $T_A$ [° C.] is equal to or higher than fourth threshold value $T_D$ [° C.], and calculated relative humidity $H_B$ [%] is lower than second threshold value $H_E$ [° C.], control portion 5 causes cooling unit 3 to execute the cooling operation, by opening opening/closing valve 64. That is, it can be determined that in a state where the temperature in the second position is significantly high, the necessity for cooling is high in the first place regardless of the likelihood of condensation, and thus, the cooling operation is executed.

When calculated relative humidity $H_B$ [%] is equal to or higher than second threshold value $H_E$ [%], control portion 5 informs the user of a condensation error by performing predetermined condensation error processing. That is, it can be determined that condensation is highly likely to form or is likely to have been formed in a state where the relative humidity in the first position is significantly high, and thus, the user is informed of this state.

The foregoing control operation can be implemented through the control flow shown in FIG. 9, for example. The control flow is performed by control portion 5 retrieving and executing a program stored in the above-described memory portion or the like, as in the foregoing first configuration example. In the control flow shown in FIG. 9, steps S201, S202, and S209 through S214 are the same as steps S101, S102, and S107 through S112 in the foregoing first configuration example, and thus, description thereof will not be repeated.

As shown in FIG. 9, in step S203, control portion 5 determines whether relative humidity $H_B$ [%] is lower than second threshold value $H_E$ [%] or not. Specifically, control portion 5 makes the above determination by comparing relative humidity $H_B$ [%] calculated in step S202 with predetermined second threshold value $H_E$ [%] at the determination portion.

Where control portion 5 determines that relative humidity $H_B$ [%] is lower than second threshold value $H_E$ [%] (YES in step S203), it moves to step S204, and where control portion 5 determines that relative humidity $H_B$ [%] is equal to or higher than second threshold value $H_E$ [%] (NO in step S203), it moves to step S209.

In step S204, control portion 5 determines whether temperature $T_A$ [° C.] is higher than third threshold value $T_C$ [° C.] or not. Specifically, control portion 5 makes the above determination by comparing temperature $T_A$ [° C.] detected in step S201 with predetermined third threshold value $T_C$ [° C.] at the determination portion.

Where control portion 5 determines that temperature $T_A$ [° C.] is higher than third threshold value $T_C$ [° C.] (YES in step S204), it moves to step S205, and where control portion 5 determines that temperature $T_A$ [° C.] is equal to or lower than third threshold value $T_C$ [° C.] (NO in step S204), it moves to step S208.

In step S205, control portion 5 determines whether relative humidity $H_B$ [%] is lower than first threshold value $H_C$ [%] or not. Specifically, control portion 5 makes the above determination by comparing relative humidity $H_B$ [%] calculated in step S202 with predetermined first threshold value $H_C$ [%] at the determination portion.

Where control portion 5 determines that relative humidity $H_B$ [%] is lower than first threshold value $H_C$ [%] (YES in step S205), it moves to step S206, and where control portion 5 determines that relative humidity $H_B$ [%] is equal to or higher than first threshold value $H_C$ [%] (NO in step S205), it moves to step S207.

In step S207, control portion 5 determines whether temperature $T_A$ [° C.] is higher than fourth threshold value $T_D$ [° C.] or not. Specifically, control portion 5 makes the above determination by comparing temperature $T_A$ [° C.] detected in step S201 with predetermined fourth threshold value $T_D$ [° C.].

Where control portion 5 determines that temperature $T_A$ [° C.] is higher than fourth threshold value $T_D$ [° C.] (YES in step S207), it moves to step S206, and where control portion 5 determines that temperature $T_A$ [° C.] is equal to or lower than fourth threshold value $T_D$ [° C.] (NO in step S207), it moves to step S208.

In step S206, control portion 5 opens opening/closing valve 64. Consequently, the cooling operation by cooling unit 3 is executed. After completion of step S206, control portion 5 returns to the operation of step S201 again.

In step S208, control portion 5 closes opening/closing valve 64. Consequently, the cooling operation by cooling unit 3 is stopped. After completion of step S208, control portion 5 returns to the operation of step S201 again.

As described above, with molecular pump 1A according to this embodiment, it is possible to continuously, stably, and accurately calculate a relative humidity in the above-described first position corresponding to the portion where condensation is most likely to form inside control unit 4. Note that if a humidity sensor is mounted in the first position, a considerable length of time will be required until the condensation liquid attached to the humidity sensor due to the formation of condensation evaporates, and consequently, during the period until the evaporation, humidity cannot be detected at all by the humidity sensor. Molecular pump 1A according to this embodiment, however, is naturally free of this problem because a humidity sensor is not mounted in the first position.

Therefore, with the configuration as described above, it is possible to continuously, stably, and accurately calculate a humidity of the portion where condensation is most likely to form, which should originally be measured. Therefore, the formation of condensation can be reliably prevented, and undesired stoppage of the cooling operation can also be avoided. Consequently, efficient operation of the molecular pump can be performed. By adopting the above-described configuration, therefore, a high-reliability and high-performance molecular pump can be achieved.

(First Modification)

Figure 10:
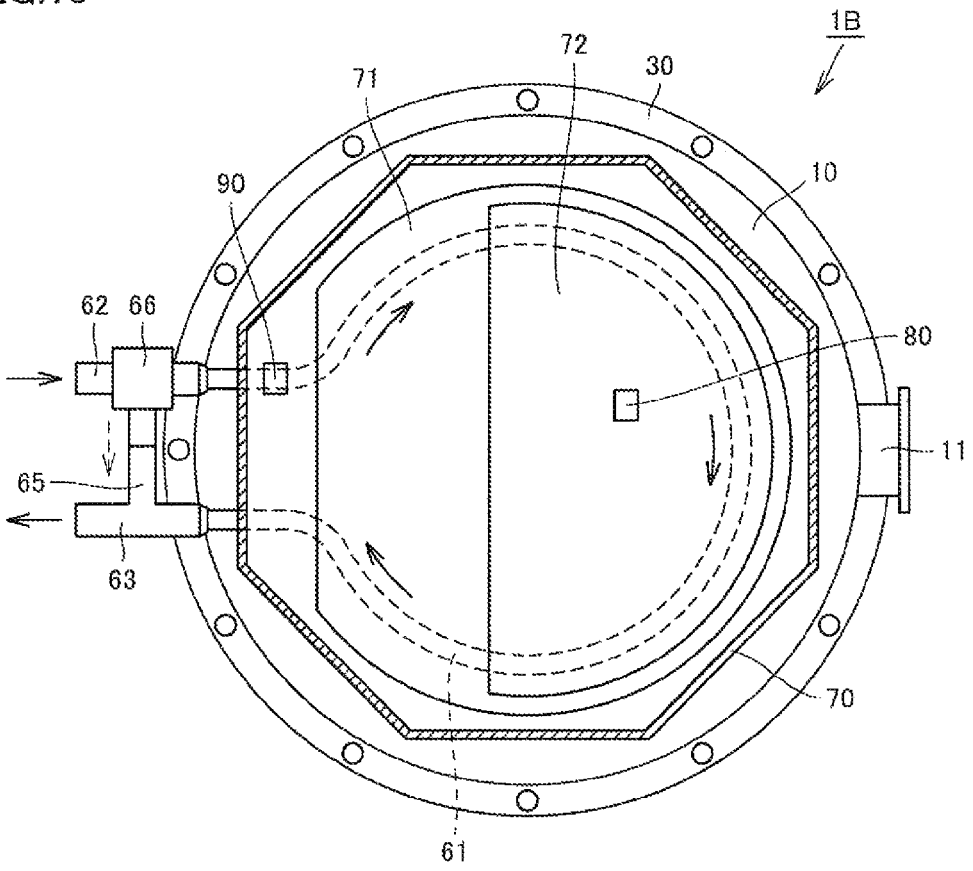
FIG. 10 is a schematic horizontal cross-sectional view of the molecular pump according to a first modification based on the first embodiment of the present invention.

FIG. 10 is a schematic horizontal cross-sectional view of the molecular pump according to a first modification based on the first embodiment. Referring to FIG. 10, a molecular pump 1B according to the first modification based on this embodiment will be described hereinafter.

As shown in FIG. 10, molecular pump 1B according to the first modification differs from the foregoing molecular pump 1A according to this embodiment only in the configuration of the piping system provided in cooling unit 3. That is, molecular pump 1B has inlet port 62, outlet port 63, a bypass pipe 65, and a switching valve 66 serving as a piping system connected to cooling liquid passage 61 provided in cooling block 60.

Bypass pipe 65 is a pipe connecting inlet port 62 and outlet port 63. Bypass pipe 65 has its one end connected to switching valve 66 provided at inlet port 62, and its other end connected to outlet port 63. Switching valve 66 is for switching the flow path of the cooling liquid supplied to inlet port 62.

In this way, in a state where not-shown liquid feed equipment and cooling liquid passage 61 are connected via inlet port 62 as a result of switching of switching valve 66, the cooling liquid is supplied to cooling liquid passage 61, so that the cooling operation by cooling unit 3 is executed. On the other hand, in a state where the not-shown liquid feed equipment and bypass pipe 65 are connected via inlet port 62 as a result of switching of switching valve 66, the supply of the cooling liquid to cooling liquid passage 61 is stopped, so that the cooling operation by cooling unit 3 is stopped.

Similarly with this configuration, switching control of switching valve 66 is performed instead of the opening/closing control of opening/closing valve 64 described in the foregoing first embodiment, thereby allowing the cooling operation by cooling unit 3 to be switched between execution and stoppage. Accordingly, a similar effect to that described in the foregoing first embodiment can be achieved.

Molecular pump 1B according to this modification can be particularly suitably used when a plurality of molecular pumps are installed close to one another, and the cooling units provided in the plurality of the molecular pumps are connected in series via a pipe through which a cooling liquid is circulated. That is, in this case, it will be necessary to selectively stop the cooling operation of any of the molecular pumps in which the cooling units are connected in series via the pipe. By adopting the above-described configuration in this case, it is possible to continuously execute the cooling operation in a molecular pump positioned downstream of the molecular pump in which the cooling operation has been stopped.

(Second Modification)

Figure 11:
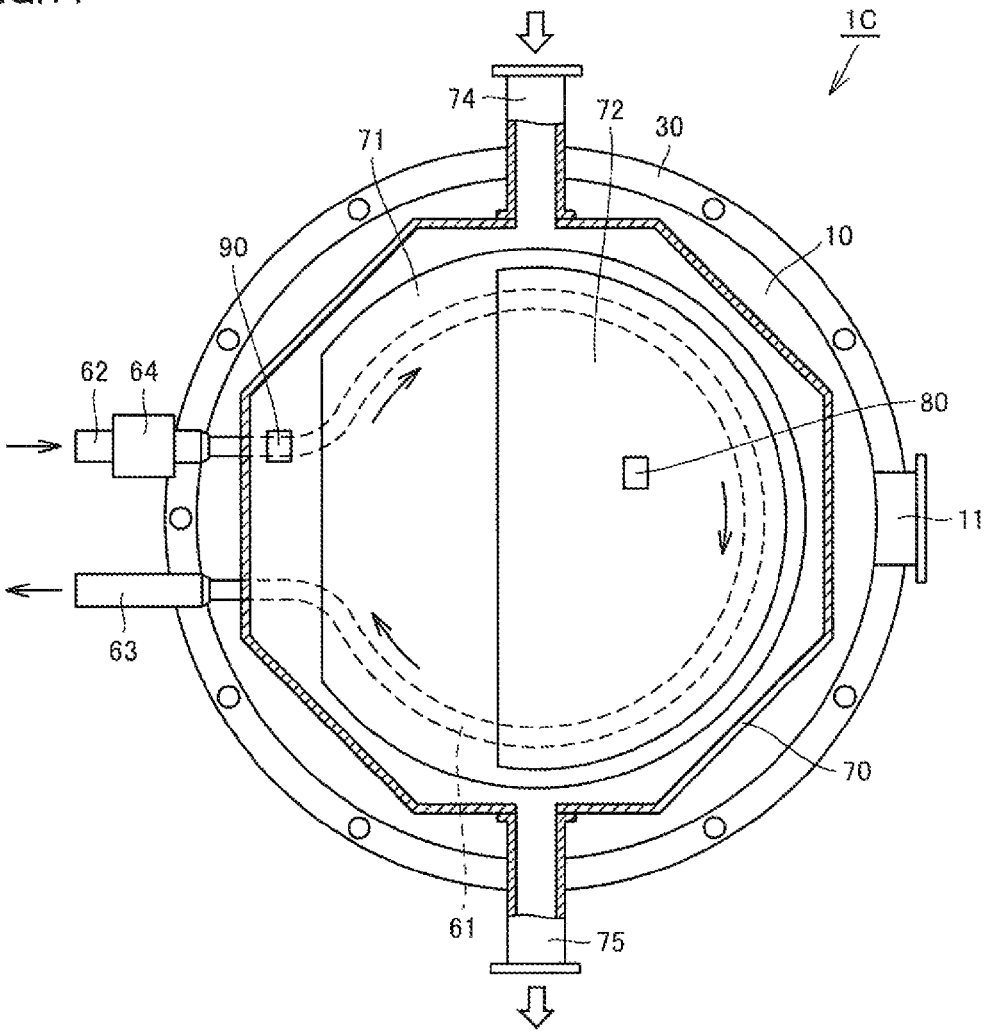
FIG. 11 is a schematic horizontal cross-sectional view of the molecular pump according to a second modification based on the first embodiment of the present invention.

FIG. 11 is a schematic horizontal cross-sectional view of the molecular pump according to a second modification based on the first embodiment. Referring to FIG. 11, a molecular pump 1C according to the second modification based on this embodiment will be described hereinafter.

As shown in FIG. 11, molecular pump 1C according to the second modification differs from molecular pump 1A according to this embodiment described above only in that cover 70 of control unit 4 is provided with a lead-in pipe 74 and a lead-out pipe 75 as a ventilation mechanism. That is, molecular pump 1C, which includes lead-in pipe 74 and lead-out pipe 75 as the ventilation mechanism described above, performs ventilation of a gas inside control unit 4, as required.

Lead-in pipe 74 is for supplying a dry gas, such as air or an inert gas such as nitrogen gas, to the space inside control unit 4. Lead-in pipe 74 has its one end connected to gas supply equipment not shown herein and its other end connected to cover 70. Lead-out pipe 75, on the other hand, is for exhausting the gas from the space inside control unit 4. Lead-out pipe 75 has its one end connected to gas exhaust equipment not shown herein and its other end connected to cover 70.

In this way, the dry gas is supplied from the gas supply equipment, whereby the ventilation (namely, purging) of the gas inside control unit 4 is performed. The ventilation operation is preferably executed in a state where the relative humidity in the above-described first position in which temperature sensor 90 is provided is comparatively high (that is, where it can be determined that condensation is likely to form). The ventilation operation is particularly suitably executed, for example, after step S106 or step 107 of the control flow shown in FIG. 7, or after step S208 or step S209 of the control flow shown in FIG. 9.

With this configuration, in addition to the effect described in the foregoing first embodiment, the ventilation operation by the ventilation mechanism described above allows the formation of condensation to be more reliably prevented, and the operation of the molecular pump to be performed more efficiently.

(Third Modification)

Figure 12:
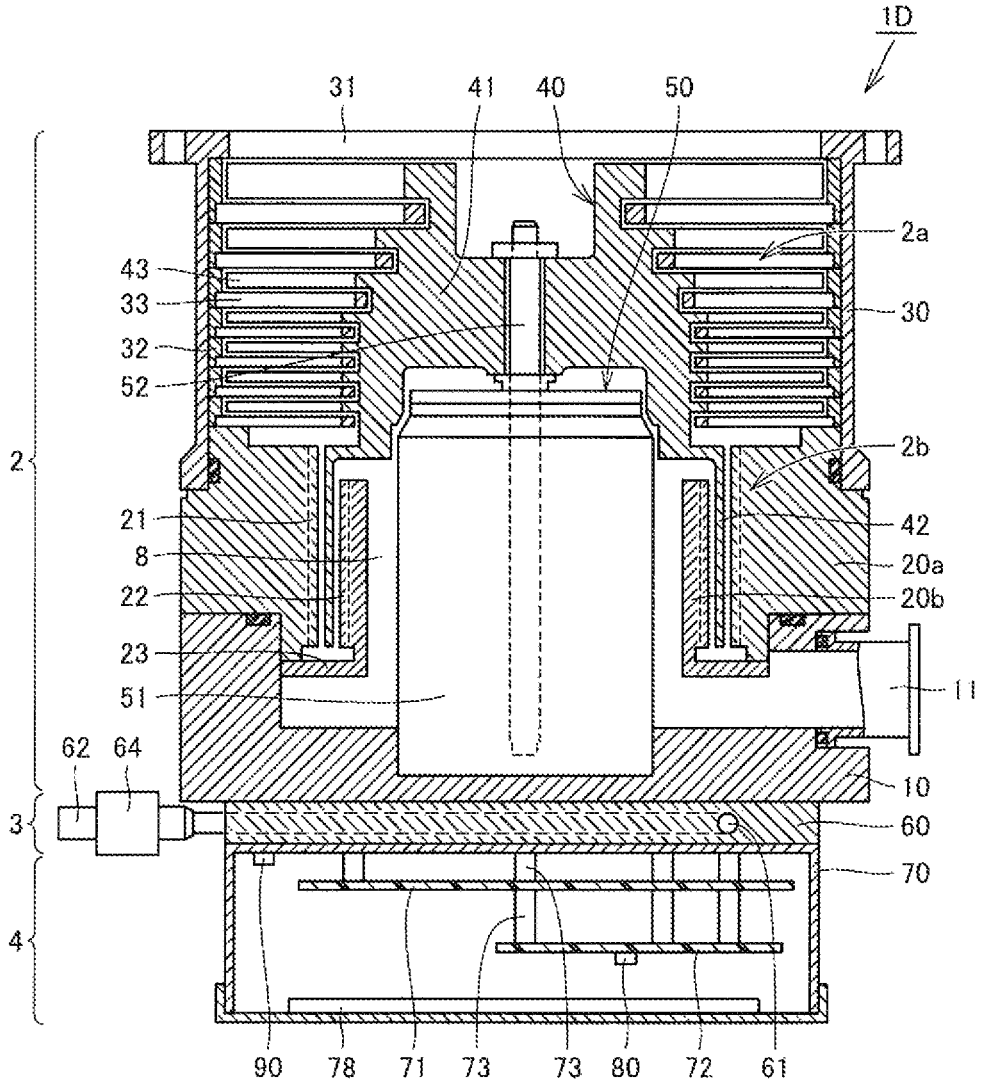
FIG. 12 is a schematic vertical cross-sectional view of the molecular pump according to a third modification based on the first embodiment of the present invention.

FIG. 12 is a schematic vertical cross-sectional view of a molecular pump according to a third modification based on the first embodiment. Referring to FIG. 12, a molecular pump 1D according to the third modification based on this embodiment will be described hereinafter.

As shown in FIG. 12, molecular pump 1D according to the third modification differs from the foregoing molecular pump 1C according to the second modification only in that a heater 78 is provided as a heating mechanism inside control unit 4. That is, molecular pump 1D, which includes heater 78 as the heating mechanism described above, performs heating of a gas inside control unit 4, as required. Note that in molecular pump 1D according to the third modification also, cover 70 is provided with lead-in pipe 74 and lead-out pipe 75 as the ventilation mechanism, although not shown in FIG. 12.

Heater 78 is made of a plane heater incorporating heating wires or the like, for example. When electricity is supplied thereto, heater 78 heats the gas inside control unit 4 to thereby promote the evaporation of a condensation liquid being formed inside control unit 4. The moisture evaporated through heating by heater 78 is discharged out of control unit 4 along with the ventilation operation by the ventilation mechanism described above. The heating operation is therefore preferably executed in a state where the relative humidity in the above-described first position in which temperature sensor 90 is provided is significantly high (that is, where it can be determined that condensation is highly likely to form or is likely to have been formed). The heating operation is particularly suitably executed in conjunction with the above-described ventilation operation, for example, after step S107 of the control flow shown in FIG. 7, or after step S209 of the control flow shown in FIG. 9.

With this configuration, in addition to the effect described in the foregoing second modification, the heating operation by the heating mechanism described above allows condensation, if present, to be quickly eliminated, and the operation of the molecular pump to be performed even more efficiently.

Second Embodiment

Figure 13:
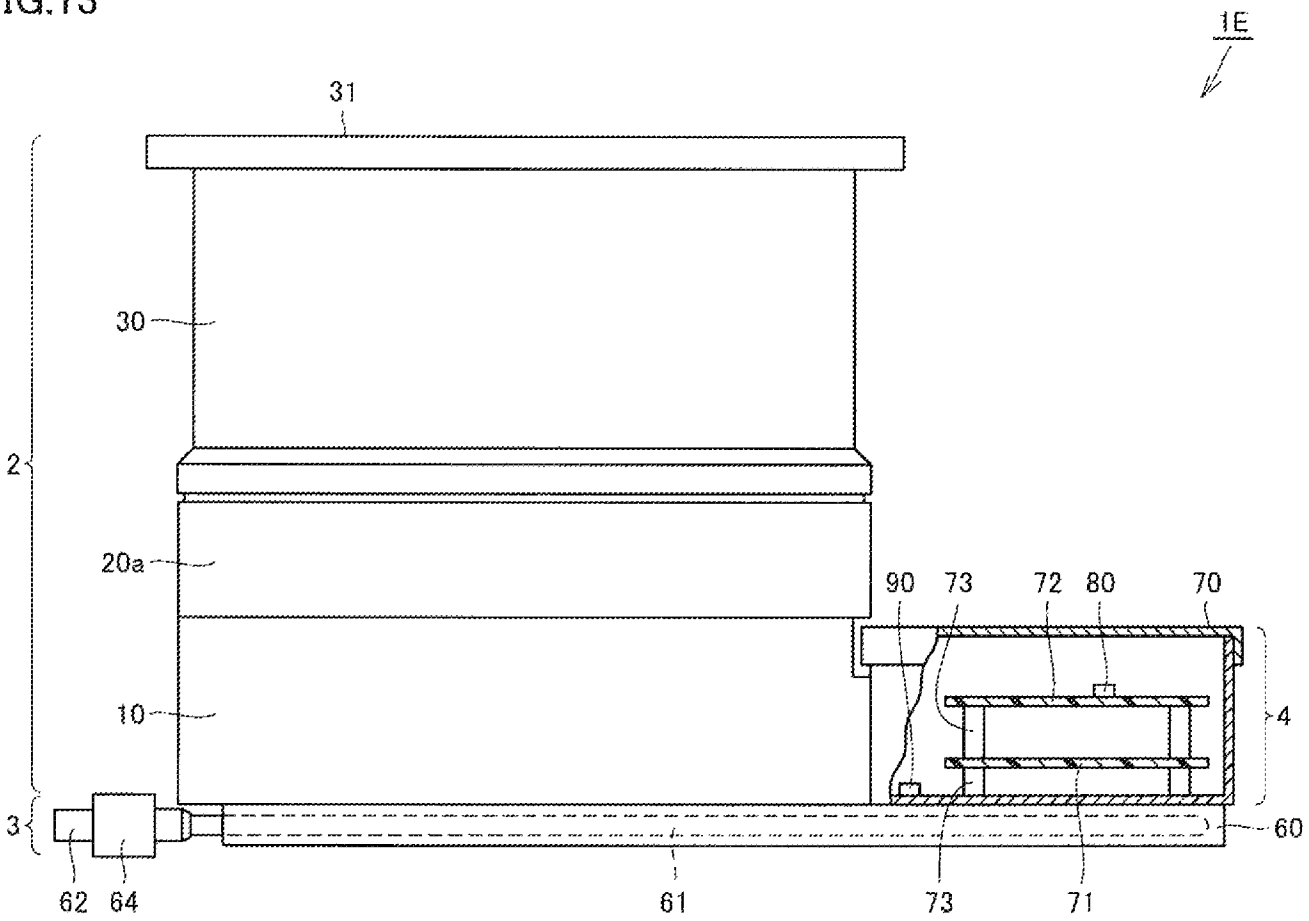
FIG. 13 is a partial cutaway front view of the molecular pump according to a second embodiment of the present invention.
Figure 14:
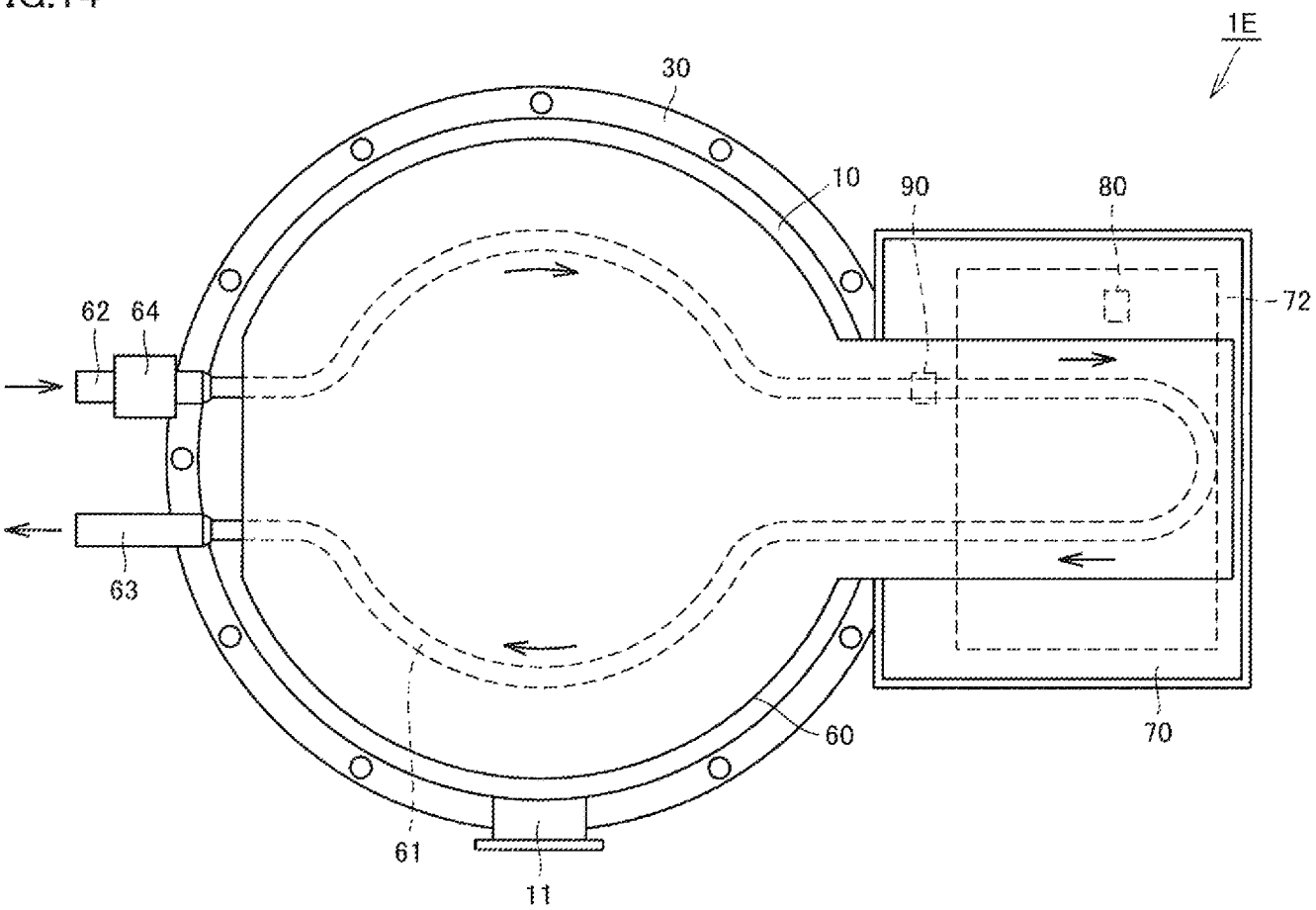
FIG. 14 is a bottom view of the molecular pump according to the second embodiment of the present invention.

FIG. 13 is a partial cutaway front view of the molecular pump according to a second embodiment of the present invention, and FIG. 14 is a bottom view of the molecular pump shown in FIG. 13. Referring to FIGS. 13 and 14, a molecular pump 1E according to this embodiment will be described hereinafter.

As shown in FIGS. 13 and 14, molecular pump 1E according to this embodiment differs from molecular pump 1A according to the foregoing first embodiment only in the layout of pump body 2, single cooling unit 3, and control unit 4. Specifically, in molecular pump 1E, pump body 2 and control unit 4 are horizontally disposed adjacent to each other, and both are disposed on cooling unit 3. Consequently, pump body 2 and control unit 4 are arranged side-by-side on cooling unit 3.

As is clear from this configuration, in molecular pump 1E according to this embodiment also, cooling unit 3 and pump body 2 are arranged in contact with each other to be brought into thermal contact, and cooling unit 3 and control unit 4 are arranged in contact with each other to be brought into thermal contact. By adopting this configuration, as in the case of molecular pump 1A according to the foregoing first embodiment, both pump body 2 and control unit 4 can be cooled with single cooling unit 3, thereby allowing the overall configuration of molecular pump 1E to be simplified.

In molecular pump 1E according to this embodiment, temperature sensor 90 is attached to a prescribed position (corresponding to the first position) on an inner surface of a bottom plate portion of cover 70. Temperature/humidity sensor 80, on the other hand, is mounted on a prescribed position (the second position) on second substrate 72. As shown in FIG. 14, temperature sensor 90 is more suitably provided in a position on an inner surface of cover 70 corresponding to a portion positioned most upstream of cooling liquid passage 61 in a section of cooling block 60 where cover 70 is arranged in contact therewith. This position is most efficiently cooled by cooling unit 3, and corresponds to the portion where condensation is most likely to form inside control unit 4.

With this configuration also, a similar effect to that described in the foregoing first embodiment can be achieved. That is, with the configuration as described above, a humidity of the portion where condensation is most likely to form, which should originally be measured, can be calculated continuously, stably, and accurately. Therefore, the formation of condensation can be reliably prevented, and undesired stoppage of the cooling operation can also be avoided. Consequently, efficient operation of the molecular pump can be performed. By adopting the above-described configuration, therefore, a high-reliability and high-performance molecular pump can be achieved.

Third Embodiment

Figure 15:
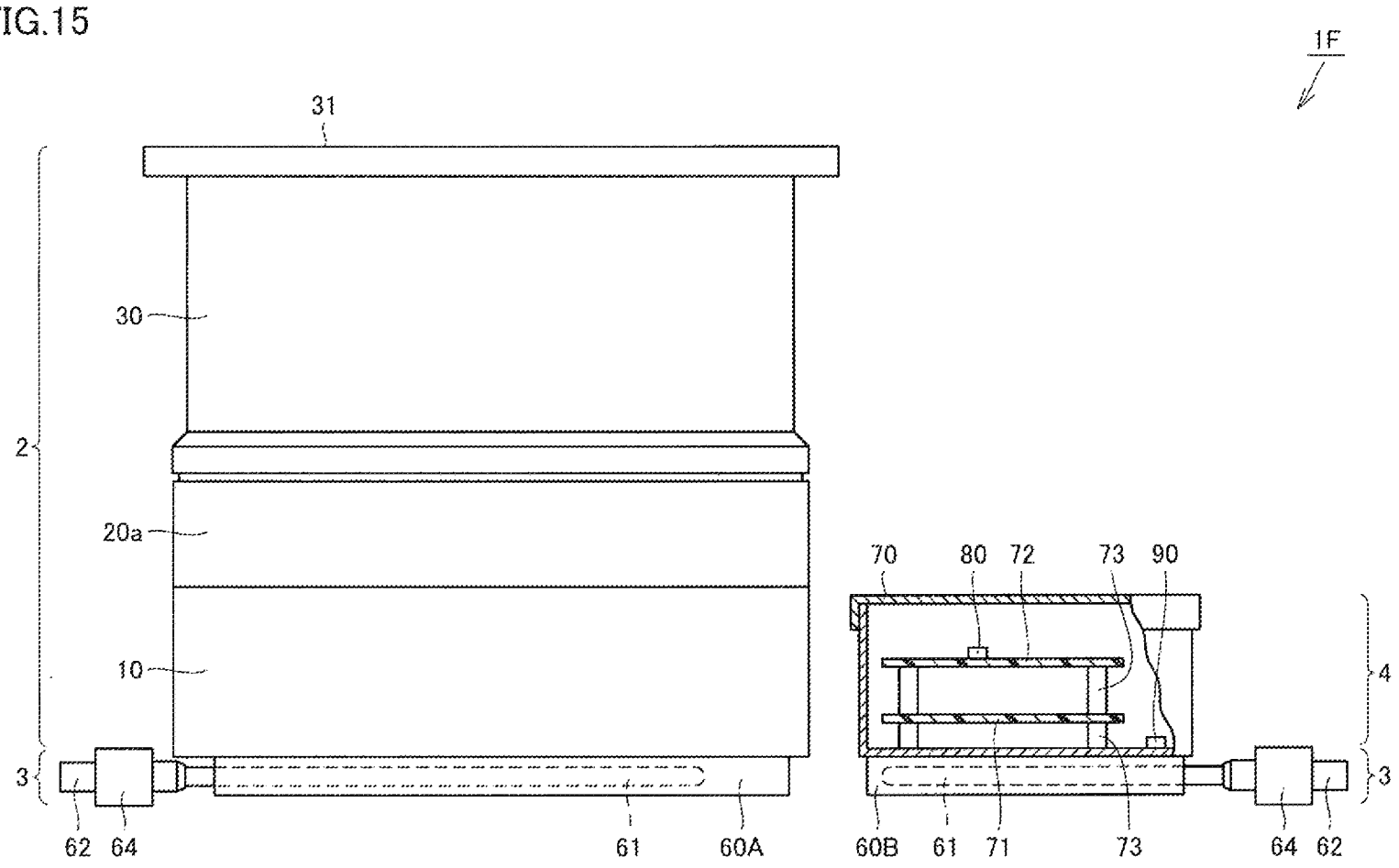
FIG. 15 is a partial cutaway front view of the molecular pump according to a third embodiment of the present invention.
Figure 16:
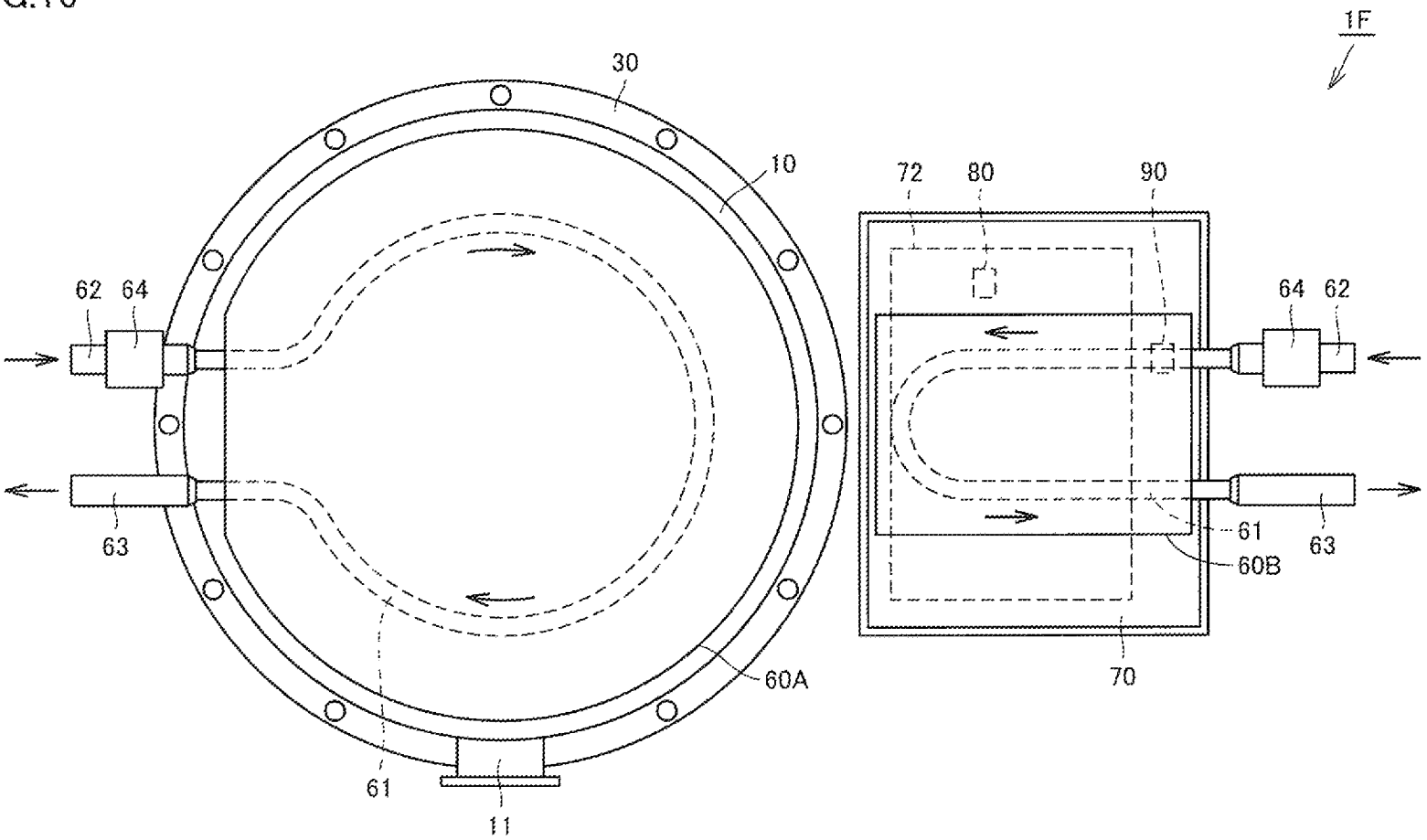
FIG. 16 is a bottom view of the molecular pump according to the third embodiment of the present invention.

FIG. 15 is a partial cutaway front view of a molecular pump according to a third embodiment of the present invention, and FIG. 16 is a bottom view of the molecular pump shown in FIG. 15. Referring to FIGS. 15 and 16, a molecular pump 1F according to this embodiment will be described hereinafter.

As shown in FIGS. 15 and 16, molecular pump 1F according to this embodiment differs from molecular pump 1E according to the foregoing second embodiment only in that a pair of cooling units 3 are provided, with one cooling unit 3 for pump body 2 and the other for control unit 4. Specifically, in molecular pump 1F, pump body 2 is arranged on cooling block 60A of one cooling unit 3, and control unit 4 is arranged on cooling block 60B of the other cooling unit 3.

Each of the pair of cooling units 3 has cooling liquid passage 61 provided in each of cooling blocks 60A and 60B, as well as inlet port 62, outlet port 63, and opening/closing valve 64 as a piping system connected to cooling liquid passage 61. Execution of the cooling operation for control unit 4 and stoppage thereof are performed by opening/closing valve 64 provided in cooling unit 3 for control unit 4 of the pair of opening/closing valves 64 described above.

With this configuration also, a similar effect to that described in the foregoing second embodiment can be achieved. That is, with the configuration as described above, a humidity of the portion where condensation is most likely to form, which should originally be measured, can be calculated continuously, stably, and accurately. Therefore, the formation of condensation can be reliably prevented, and undesired stoppage of the cooling operation can also be avoided. Consequently, efficient operation of the molecular pump can be performed. By adopting the above-described configuration, therefore, a high-reliability and high-performance molecular pump can be achieved.

In each of the foregoing first to third embodiments and their modifications of the present invention, the case has been described as an example in which execution of the cooling operation by the cooling unit and stoppage thereof are performed by controlling the opening/closing operation of the opening/closing valve or the switching operation of the switching valve provided in the cooling unit. However, when the molecular pump itself incorporates a feeding mechanism such as a pump or the like for feeding a cooling liquid, execution of the cooling operation by the cooling unit and stoppage thereof may be controlled by controlling the operation of the feeding mechanism. Alternatively, a flow control valve may be provided in the cooling unit instead of the opening/closing valve or the switching valve, so as to finely control execution of the cooling operation by the cooling unit, by adjusting the position of the flow control valve as appropriate.

Furthermore, in each of the second and third modifications based on the foregoing first embodiment of the present invention, the case has been described as an example in which the lead-in pipe and the lead-out pipe as the ventilation mechanism are provided on the cover of the control unit. However, alternatively, or additionally, the control unit may incorporate a feeding mechanism for feeding a gas, such as a fan or the like, as the ventilation mechanism. In that case, execution of the ventilation operation and stoppage thereof may be controlled by controlling the operation of the feeding mechanism. Furthermore, considering that the cover is semi-hermetic, the exhaust pipe may be optional.

Furthermore, in each of the foregoing first to third embodiments and their modifications of the present invention, the case has been described as an example in which the portion where condensation is most likely to form on the cover is selected as the above-described first position in which the temperature sensor is mounted; however, this portion may not necessarily be selected as the first position. Any portion where condensation is comparatively likely to form may be selected as the above-described first position.

Furthermore, in each of the foregoing first to third embodiments and their modifications of the present invention, the case has been described as an example in which the position on the circuit board is selected as the above-described second position in which the temperature/humidity sensor is mounted; however, this portion may not necessarily be selected as the second position. Any portion where condensation is comparatively less likely to form may be selected as the above-described second position.

Furthermore, in each of the foregoing first to third embodiments and their modifications of the present invention, the case has been described as an example in which the composite sensor having both a temperature sensor and a humidity sensor is attached to the above-described second position. However, a temperature sensor and a humidity sensor may be independently formed as discrete sensors.

Furthermore, in each of the foregoing first to third embodiments and their modifications of the present invention, the case has been described as an example in which the control unit is configured to control not only the cooling operation by the cooling unit, but also the operation of the pump body, and additionally the operation of the ventilation mechanism and the operation of the heating mechanism, based on the calculated relative humidity in the above-described first position. Naturally, however, the control unit may be configured to control only the cooling operation by the cooling unit.

Furthermore, the first and second configuration examples of the control operation shown in the foregoing first embodiment of the present invention are strictly intended to merely illustrate examples of specific control operation. Naturally, control operation other than that of the first and second configuration examples can also be adopted.

Furthermore, in each of the foregoing first to third embodiments and their modifications of the present invention, the case has been described as an example in which the present invention is applied to the so-called composite molecular pumps wherein a turbo molecular pump portion and a spiral groove vacuum pump portion are arranged together. Naturally, however, the present invention can be provided as a turbo molecular pump without a spiral groove vacuum pump portion.

Furthermore, naturally, characteristic features disclosed in the foregoing first to third embodiments and their modifications of the present invention can be combined within the scope accepted in light of the spirit of the present invention.

As described above, the foregoing embodiments and their modifications disclosed herein are illustrative and non-restrictive in every respect. The technical scope of the present invention is defined by the terms of the claims, and is intended to include any modifications within the scope and meaning equivalent to the terms of the claims

REFERENCE SIGNS LIST

1A-1F: molecular pump; 2: pump body; 2*a*: turbo molecular pump portion; 2*b*: spiral groove vacuum pump portion; 3: cooling unit; 4: control unit; 5: control portion; 6: power supply portion; 8: exhaust path; 10: base; 11: exhaust pipe; 20*a*: outer stator; 20*b*: inner stator; 21: primary spiral groove portion; 22: secondary spiral groove portion; 23: closing portion; 30: casing; 31: intake port; 32: spacer/support member; 33: stator blade; 40: rotor; 41: upper rotor portion; 42: lower rotor portion; 43: rotor blade; 50: rotor drive mechanism; 51: housing; 52: rotation shaft; 53: motor; 54: magnetic bearing; 55: motor drive circuit; 56: magnetic bearing drive circuit; 60: cooling block; 61: cooling liquid passage; 62: inlet port; 63: outlet port; 64: opening/closing valve; 65: bypass pipe; 66: switching valve; 67: opening/closing valve drive circuit; 70: cover; 71: first substrate; 72: second substrate; 73: spacer/support member; 74: lead-in pipe; 75: lead-out pipe; 78: heater; 80: temperature/humidity sensor; 90: temperature sensor.

The invention claimed is:

1. A molecular pump comprising:

a pump body provided with a turbo molecular pump portion including a rotor blade and a stator blade;

a control unit provided with a control portion and a power supply portion;

a cooling unit for cooling said control unit; and a ventilator for ventilation of a gas inside said control unit;

said control unit being arranged in contact with said cooling unit, such that said cooling unit and said control unit are brought into thermal contact, said control unit having a cover in which said control portion and said power supply portion are accommodated, a first temperature detecting portion being provided in a first position, said first position being a position inside said cover and having a low temperature during operation of said cooling unit;

a humidity detecting portion and a second temperature detecting portion being provided in a second position, said second position being a position inside said cover and having a temperature higher than the temperature of said first position during the operation of said cooling unit;

said control portion controlling the operation of said cooling unit in accordance with a relative humidity in said first position, calculated based on temperature information detected by said first temperature detecting portion and said second temperature detecting portion, and humidity information detected by said humidity detecting portion; and said control portion controlling operation of said ventilator based on said relative humidity.

2. The molecular pump according to claim 1, wherein said control portion causes said cooling unit to execute the cooling operation where said relative humidity is equal to or lower than a predetermined threshold value, and causes said cooling unit to stop the cooling operation where said relative humidity is higher than said threshold value.

3. The molecular pump according to claim 1, wherein said first position is a position on an inner surface of said cover corresponding to a portion arranged in contact with said cooling unit, and said second position is a position other than a position on the inner surface of said cover corresponding to the portion arranged in contact with said cooling unit.

4. The molecular pump according to claim 1, wherein said second position is a position on a circuit board disposed inside said control unit.

5. The molecular pump according to claim 1, wherein said control portion controls operation of said turbo molecular pump portion based on said relative humidity.

6. The molecular pump according to claim 1, further comprising:

a heater for heating the gas inside said control unit, wherein said control portion controls operation of said heater based on said relative humidity.

7. The molecular pump according to claim 1, wherein said cooling unit is also for cooling said pump body, and said pump body is arranged in contact with said cooling unit such that said cooling unit and said pump body are brought into thermal contact.

8. The molecular pump according to claim 7, wherein said cooling unit is disposed to be sandwiched between said pump body and said control unit.

9. The molecular pump according to claim 7, wherein said pump body and said control unit are arranged side-by-side on said cooling unit.

* * * * *